US009598910B2

(12) United States Patent
Myers et al.

(10) Patent No.: US 9,598,910 B2
(45) Date of Patent: Mar. 21, 2017

(54) ROTATIONAL DRILL BITS AND DRILLING APPARATUSES INCLUDING THE SAME

(71) Applicant: Dover BMCS Acquisition Corporation, Orem, UT (US)

(72) Inventors: Russell Roy Myers, Provo, UT (US); E. Sean Cox, Spanish Fork, UT (US)

(73) Assignee: DOVER BMCS ACQUISITION CORPORATION, Orem, UT (US)

( * ) Notice: Subject to any disclaimer, the term of this patent is extended or adjusted under 35 U.S.C. 154(b) by 58 days.

(21) Appl. No.: 14/341,730

(22) Filed: Jul. 25, 2014

(65) Prior Publication Data

US 2014/0332284 A1 Nov. 13, 2014

Related U.S. Application Data

(63) Continuation of application No. 14/038,657, filed on Sep. 26, 2013, now Pat. No. 8,807,249, and a continuation of application No. 12/857,825, filed on Aug. 17, 2010, now Pat. No. 8,567,533.

(51) Int. Cl.

| | |
|---|---|
| ***E21B 10/633*** | (2006.01) |
| ***E21B 10/58*** | (2006.01) |
| ***E21D 20/00*** | (2006.01) |
| ***E21B 10/56*** | (2006.01) |

(52) U.S. Cl.

CPC ..... *E21B 10/58* (2013.01); *E21B 10/56* (2013.01); *E21B 10/633* (2013.01); *E21D 20/00* (2013.01)

(58) Field of Classification Search

None

See application file for complete search history.

(56) References Cited

U.S. PATENT DOCUMENTS

| | | | |
|---|---|---|---|
| 2,506,341 | A | 5/1950 | Bullock |
| 2,631,360 | A | 3/1953 | Sanford et al. |
| 2,710,180 | A | 6/1955 | Graham |
| 2,917,819 | A | 12/1959 | Britton et al. |
| 3,136,615 | A | 6/1964 | Bovenkerk et al. |
| 3,141,746 | A | 7/1964 | De Lai |
| 3,152,654 | A | 10/1964 | Conover |
| 3,271,080 | A | 9/1966 | Gowanlock |
| 3,749,190 | A | 7/1973 | Shipman |
| 3,765,496 | A | 10/1973 | Flores |
| 4,014,395 | A | 3/1977 | Pearson |
| 4,047,583 | A | 9/1977 | Dyer |
| 4,057,884 | A | 11/1977 | Suzuki |

(Continued)

OTHER PUBLICATIONS

International Search Report and Written Opinion received in PCT Application No. PCT/US2011/047352 on Jan. 16, 2013.

*Primary Examiner* — Giovanna C Wright

(74) *Attorney, Agent, or Firm* — FisherBroyles, LLP

(57) ABSTRACT

A roof-bolt drill bit includes a bit body that is rotatable about a central axis, a coupling pocket defined in the bit body, and at least one cutting element mounted to the bit body. The at least one cutting element includes a cutting face, a cutting edge adjacent the cutting face, a back surface opposite the cutting face, and a side surface extending between the cutting edge and the back surface. The roof-bolt drill bit additionally includes a coupling attachment coupled to the bit body, the coupling attachment being positioned adjacent to a portion of the side surface of the cutting element that abuts a side surface of the coupling pocket.

16 Claims, 23 Drawing Sheets

(56) References Cited

U.S. PATENT DOCUMENTS

| | | | | | |
|---|---|---|---|---|---|
| 4,199,035 | A | | 4/1980 | Thompson | |
| 4,200,159 | A | | 4/1980 | Peschel et al. | |
| 4,337,980 | A | | 7/1982 | Krekeler | |
| 4,433,739 | A | * | 2/1984 | Sarin | E21B 10/58 175/418 |
| 4,453,605 | A | | 6/1984 | Short, Jr. | |
| 4,466,498 | A | | 8/1984 | Bardwell | |
| 4,511,006 | A | | 4/1985 | Grainger | |
| 4,529,048 | A | | 7/1985 | Hall | |
| 4,538,690 | A | | 9/1985 | Short, Jr. | |
| 4,553,615 | A | | 11/1985 | Grainger | |
| 4,603,751 | A | * | 8/1986 | Erickson | E21B 10/58 175/420.1 |
| 4,654,947 | A | | 4/1987 | Davis | |
| 4,694,918 | A | | 9/1987 | Hall | |
| 4,712,626 | A | * | 12/1987 | Shaw | E21B 10/62 175/418 |
| 4,782,903 | A | | 11/1988 | Strange | |
| 4,802,539 | A | | 2/1989 | Hall et al. | |
| 4,877,096 | A | | 10/1989 | Tibbitts | |
| 5,007,493 | A | | 4/1991 | Coolidge et al. | |
| 5,007,685 | A | | 4/1991 | Beach et al. | |
| 5,056,382 | A | | 10/1991 | Clench | |
| 5,279,375 | A | | 1/1994 | Tibbitts et al. | |
| 5,332,051 | A | | 7/1994 | Knowlton | |
| 5,351,772 | A | | 10/1994 | Smith | |
| 5,469,927 | A | | 11/1995 | Griffin | |
| 5,558,170 | A | | 9/1996 | Thigpen et al. | |
| 5,678,645 | A | | 10/1997 | Tibbitts et al. | |
| 5,810,103 | A | | 9/1998 | Torbet | |
| 5,871,060 | A | | 2/1999 | Jensen | |
| 5,906,245 | A | | 5/1999 | Tibbitts et al. | |
| 5,975,811 | A | | 11/1999 | Briese | |
| 6,026,918 | A | | 2/2000 | Briese | |
| 6,109,377 | A | | 8/2000 | Massa | |
| 6,260,638 | B1 | | 7/2001 | Massa | |
| 6,283,234 | B1 | | 9/2001 | Torbet | |
| 6,302,224 | B1 | | 10/2001 | Sherwood, Jr. | |
| 6,374,932 | B1 | | 4/2002 | Brady | |
| 6,408,959 | B2 | | 6/2002 | Bertagnolli et al. | |
| 6,595,305 | B1 | | 7/2003 | Dunn | |
| 6,915,867 | B2 | | 7/2005 | Bise | |
| 7,533,739 | B2 | | 5/2009 | Cooley | |
| 7,604,073 | B2 | | 10/2009 | Cooley | |
| 7,942,218 | B2 | | 5/2011 | Cooley et al. | |
| 8,002,054 | B2 | | 8/2011 | Swope | |
| 8,079,431 | B1 | | 12/2011 | Cooley | |
| 8,528,670 | B1 | | 9/2013 | Cooley et al. | |
| 2004/0026132 | A1 | | 2/2004 | Hall et al. | |
| 2005/0072601 | A1 | | 4/2005 | Griffo et al. | |
| 2005/0103533 | A1 | | 5/2005 | Sherwood, Jr. et al. | |
| 2008/0115977 | A1 | | 5/2008 | Hall et al. | |
| 2009/0000828 | A1 | | 1/2009 | Hall et al. | |
| 2010/0089661 | A1 | | 4/2010 | Welch | |

* cited by examiner

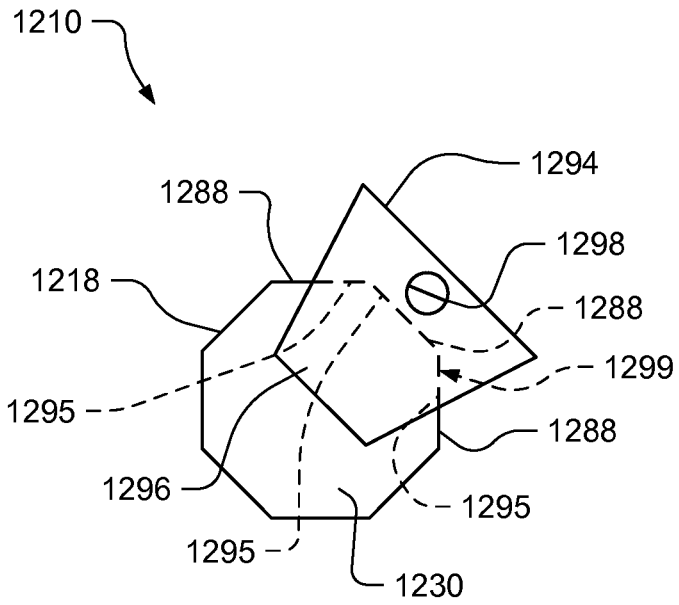
FIG. 22D
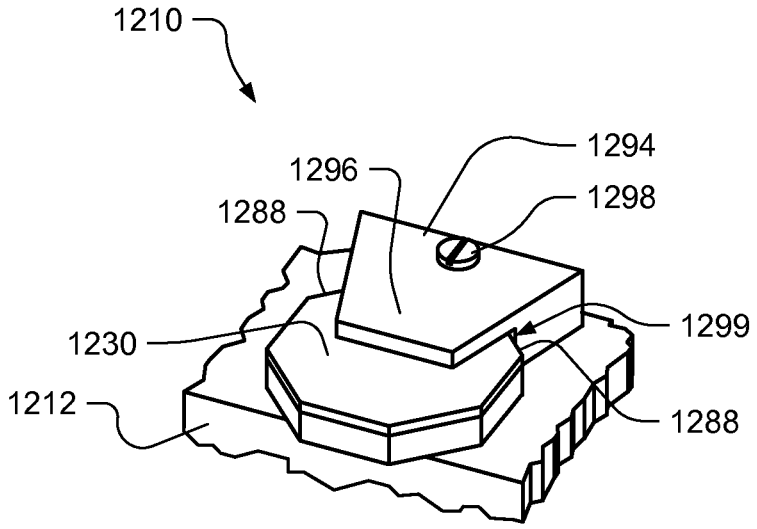

ROTATIONAL DRILL BITS AND DRILLING APPARATUSES INCLUDING THE SAME

REFERENCE TO RELATED APPLICATIONS

This application is a continuation of U.S. patent application Ser. No. 14/038,657 filed 26 Sep. 2013, which is a continuation of U.S. patent application Ser. No. 12/857,825 filed 17 Aug. 2010 (issued as U.S. Pat. No. 8,567,533 on 29 Oct. 2013), each of which is hereby incorporated by reference in its entirety.

BACKGROUND

Cutting elements are traditionally utilized for a variety of material removal processes, such as machining, cutting, and drilling. For example, tungsten carbide cutting elements have been used for machining metals and on drilling tools for drilling subterranean mining formations. Similarly, polycrystalline diamond compact (PDC) cutters have been used to machine metals (e.g., non-ferrous metals) and on subterranean drilling tools, such as drill bits, reamers, core bits, and other drilling tools. Other types of cutting elements, such as ceramic (e.g., cubic boron nitride, silicon carbide, and the like) cutting elements or cutting elements formed of other materials have also been utilized for cutting operations.

Drill bit bodies to which cutting elements are attached are often formed of steel or of molded tungsten carbide. Drill bit bodies formed of molded tungsten carbide (so-called matrix-type bit bodies) are typically fabricated by preparing a mold that embodies the inverse of the desired topographic features of the drill bit body to be formed. Tungsten carbide particles are then placed into the mold and a binder material, such as a metal including copper and tin, is melted or infiltrated into the tungsten carbide particles and solidified to form the drill bit body. Steel drill bit bodies, on the other hand, are typically fabricated by machining a piece of steel to form the desired external topographic features of the drill bit body.

In some situations, drill bits employing cutting elements may be used in subterranean mining to drill roof-support holes. For example, in underground mining operations, such as coal mining, tunnels must be formed underground. In order to make the tunnels safe for use, the roofs of the tunnels must be supported in order to reduce the chances of a roof cave-in and/or to block various debris falling from the roof. In order to support a roof in a mine tunnel, boreholes are typically drilled into the roof using a drilling apparatus. The drilling apparatus commonly includes a drill bit attached to a drilling rod (commonly referred to a "drill steel"). Roof bolts are then inserted into the boreholes to support the roof and/or to anchor a support panel to the roof. The drilled boreholes may be filled with a hardenable resin prior to inserting the bolts, or the bolts may have self expanding portions, in order to anchor the bolts to the roof.

Various types of cutting elements, such as PDC cutters, have been employed for drilling boreholes for roof bolts. Although other configurations are known in the art, PDC cutters often comprise a substantially cylindrical or semi-cylindrical diamond "table" formed on and bonded under high-pressure and high-temperature (HPHT) conditions to a supporting substrate, such as a cemented tungsten carbide (WC) substrate.

During drilling operations, heat may be generated in the cutting elements due to friction between the cutting elements and a mining formation being drilled. Additionally, the cutting elements may be subjected to various compressive, tensile, and shear stresses as the cutting elements are forced against rock material during drilling operations. The combination of stresses and/or heat may cause portions of cutting elements to become worn and/or damaged from drilling. For example, portions of a cutting element that come into forceful contact with a rock formation during drilling may experience spalling, chipping, and/or delamination, decreasing the cutting effectiveness of the cutting element. Often, cutting elements and drill bits are disposed of when cutting portion of the cutting elements mounted to the drill bits become excessively worn and/or damaged.

Additionally, the combination of stresses and/or heat generated during drilling may cause cutting elements to become dislodged from drill bits. For example, stresses and heat may weaken a braze joint holding a cutting element to a bit body, resulting in displacement of the cutting element from the bit body. Such problems may cause delays and increase expenses during drilling operations. Avoiding such delays may reduce unnecessary downtime and production losses, which may be particularly important during bolting operations in mine tunnels due to various safety hazards present in these environments.

SUMMARY

The instant disclosure is directed to exemplary roof-bolt drill bits. In some embodiments, a roof-bolt drill bit may comprise a bit body that is rotatable about a central axis and at least one cutting element mounted to the bit body. The at least one cutting element may comprise a cutting face, a cutting edge adjacent the cutting face, a back surface opposite the cutting face, and at least one coupling feature positioned adjacent the at least one cutting element. The at least one cutting element may comprise a superabrasive material (e.g., polycrystalline diamond) bonded to a substrate (e.g., a tungsten carbide substrate). The at least one cutting element may be secured to the bit body by the at least one coupling feature.

According to at least one embodiment, the at least one coupling feature may comprise a coupling recess defined in the bit body. The roof-bolt drill bit may additionally comprise a coupling projection that extends from the back surface of the at least one cutting element and is positioned within the coupling recess defined in the bit body. The coupling projection may be bonded or otherwise adhered to the back surface of the at least one cutting element or may be formed from a portion of the substrate.

According to certain embodiments, a coupling recess may be defined in the at least one cutting element. The at least one coupling feature may comprise a coupling projection that extends from the bit body and is positioned generally within the coupling recess. In at least one embodiment, the coupling projection may comprise a portion of a coupling attachment extending through an opening defined in the bit body. In some embodiments, the roof-bolt drill bit may comprise a coupling insert positioned generally within the coupling recess and the coupling projection may be at least partially surrounded by the coupling insert.

According to various embodiments, the at least one coupling feature may comprise a coupling pocket defined in the bit body. The coupling pocket may comprise an engagement surface and the at least one cutting element may comprise a side surface portion that corresponds to the engagement surface. The at least one cutting element may be disposed within the coupling pocket such that the side surface portion of the at least one cutting element is positioned adjacent the engagement surface of the coupling pocket. In some embodiments, at least a portion of the coupling pocket may be defined by a coupling projection extending away from the engagement surface and the at least one cutting element may comprise a coupling recess corresponding to the coupling projection.

According to at least one embodiment, the at least one coupling feature may comprise a locking member that is attached to the bit body. The locking member may be movable between an unlocked position and a locked position and the locking member may be positioned adjacent the at least one cutting element in the locked position so that the cutting element is secured to the bit body. At least a portion of the locking member may be positioned adjacent at least one of the cutting face and a side surface of the cutting element. In certain embodiments, the cutting element may comprise a coupling recess and at least a portion of the locking member may be positioned within the coupling recess.

According to some embodiments, the at least one cutting element may comprise two cutting elements positioned circumferentially substantially 180° apart with substantially the same back rake and side rake angles. In various examples, the roof-bolt drill bit may comprise a coupling attachment that is secured to the bit body such that at least a portion of the cutting element is positioned between the coupling attachment and the bit body. The coupling attachment may comprise at least one engagement feature that is positioned adjacent the at least one cutting element.

According to certain embodiments, a roof-bolt drill bit may comprise a bit body that is rotatable about a central axis and at least one cutting element that is mounted to the bit body. The at least one cutting element may comprise a cutting face, a cutting edge adjacent the cutting face, a back surface opposite the cutting face, and a coupling feature. The at least one cutting element may be secured to the bit body by the coupling feature.

According to various embodiments, a roof-bolt drill bit may comprise a bit body that is rotatable about a central axis. The bit body may comprise a forward end and a rearward end and an engagement recess may be defined in the bit body. The engagement recess may comprise a rearward surface and at least one side surface. The roof-bolt drill bit may also comprise a cutting element assembly that includes a coupling projection and at least one cutting portion comprising a cutting face and a cutting edge adjacent the cutting face. The cutting element assembly may be coupled to the bit body so that the coupling projection is positioned generally within the coupling recess. The coupling projection may be disposed adjacent the rearward surface and the at least one side surface of the engagement recess. In some embodiments, the cutting element assembly may be bonded to at least one of the rearward surface and the at least one side surface.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

FIG. 22D is a top view of the exemplary coupling attachment illustrated in FIGS. 22B and 22C positioned over the exemplary cutting element illustrated in FIG. 22A.

FIG. 22E is a perspective view of a portion of an exemplary drill bit assembly that includes the exemplary cutting element and coupling attachment illustrated in FIGS. 22A-22D.

Figure 1:
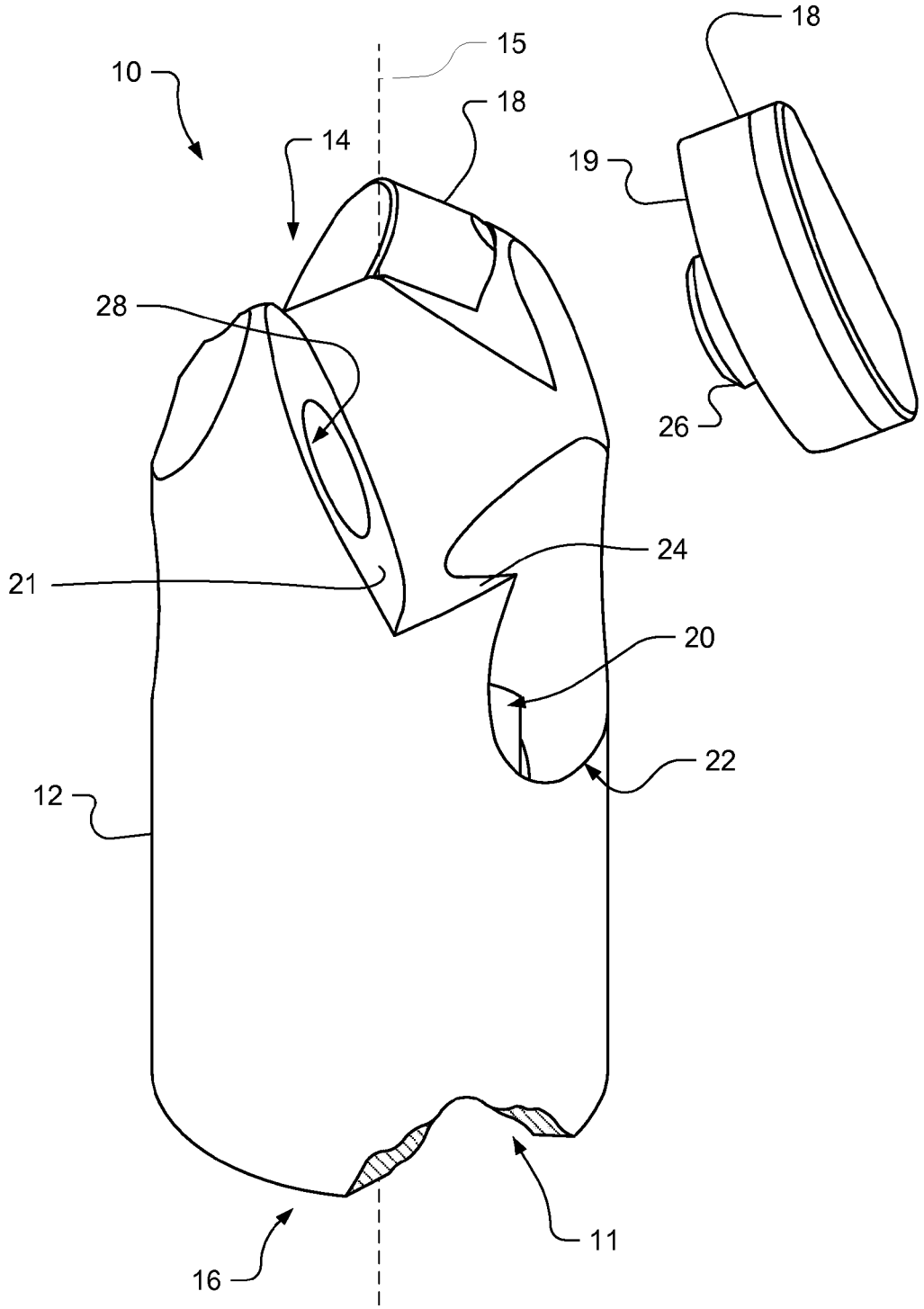
FIG. 1 is a partial cut-away exploded view of an exemplary drill bit according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The instant disclosure is directed to exemplary rotary drill bits, such as roof-bolt drill bits, for drilling mining formations in various environments, including wet-drilling and dry-drilling environments. For example, a roof-bolt drill bit may be coupled to a drill steel and rotated by a rotary drilling apparatus configured to rotate the drill bit relative to a mining formation. The phrase "wet-drilling environment," as used herein, may refer to drilling operations where drilling mud, water, and/or other drilling lubricants are supplied to a drill bit during cutting or drilling operation. In contrast, the phrase "dry-drilling environment," as used herein, may refer to drilling operations that do not utilize drilling mud or other liquid lubricants during cutting or drilling operations. For ease of use, the word "cutting," as used in this specification and claims, may refer broadly to machining processes, drilling processes, boring processes, or any other material removal process.

FIG. 1 shows an exemplary drill bit 10 according to at least one embodiment. Drill bit 10 may represent any type or form of earth-boring or drilling tool, including, for example, a rotary borehole drill bit. Drill bit 10 may be formed of any material or combination of materials, such as steel and/or molded tungsten carbide, without limitation.

As illustrated FIG. 1, drill bit 10 may comprise a bit body 12 having a forward end 14 and a rearward end 16. Drill bit 10 may be rotatable about a central axis 15. At least one cutting element 18 may be coupled to bit body 12. For example, as shown in FIG. 1, a plurality of cutting elements 18 may be coupled to forward end 14 of bit body 12. According to some embodiments, back surfaces 19 of cutting elements 18 may be mounted and secured to mounting surfaces on bit body 12, such as mounting surface 21 shown in FIG. 1. Additionally, each cutting element 18 may be positioned on bit body 12 adjacent to and/or abutting a support member 24. As illustrated in FIG. 1, support member 24 may comprise a projection extending away from mounting surface 21. Support member 24 may counteract various forces applied to cutting element 18 during drilling, including forces acting on cutting element 18 in a generally sideward and/or rearward direction, thereby preventing movement of cutting element 18 and/or separation of cutting element 18 from bit body 12.

In at least one embodiment, an internal passage 20 may be defined within bit body 12. As illustrated in FIG. 1, in some embodiments internal passage 20 may extend from a rearward opening 11 defined in rearward end 16 of bit body 12 to at least one side opening 22 defined in a side portion of bit body 12. As shown in FIG. 1, a side opening 22 may be disposed adjacent a cutting element 18. Side opening 22 may also be disposed axially rearward of cutting elements 18

(i.e., between cutting elements 18 and rearward end 16 of bit body 12). In one embodiment, internal passage 20 may be configured to draw debris, such as rock cuttings, away from cutting elements 18. For example, a vacuum source may be attached to rearward opening 11 of internal passage 20 to draw cutting debris away from cutting elements 18 and through side opening 22 into internal passage 20. In some embodiments, drill bit 10 may include drilling studs defined on an exterior of bit body 12.

In various embodiments, each cutting element 18 may include at least one coupling projection extending from back surface 19. For example, as illustrated in FIG. 1, a coupling projection 26 may extend from back surface 19 of cutting element 18. Coupling projection 26 may be configured to fit within a corresponding coupling recess 28 defined within bit body 12. In some embodiments, coupling recess 28 may be defined inwardly from mounting surface 21 in bit body 12. As illustrated in FIG. 1, coupling projection 26 may have a substantially cylindrical periphery corresponding to coupling recess 28, which comprises a slightly larger cylindrical periphery defined within bit body 12. Coupling projection 26 and coupling recess 28 may also comprise any other suitable shape or configuration, without limitation. In some embodiments, when coupling projection 26 is positioned within coupling recess 28, back surface 19 of cutting element 18 may be positioned adjacent to and/or abutting mounting surface 21.

Coupling projection 26 may be formed on and/or bonded to cutting element 18 using any suitable technique, without limitation. In at least one embodiment, coupling projection 26 may be formed separately from cutting element 18. For example, coupling projection 26 may comprise a separately formed member that is bonded to cutting element 18 through brazing, welding, and/or any other suitable bonding technique. In at least one embodiment, coupling projection 26 may be brazed to a substrate portion of cutting element 18 (e.g., substrate 27 illustrated in FIG. 2) using a high temperature brazing technique involving brazing temperatures of approximately 1400° F. (approximately 800° C.) or higher. Brazing coupling projection 26 to cutting element 18 using a high temperature brazing technique may produce a strong bond between coupling projection 26 and cutting element 18 that prevents separation of coupling projection 26 from cutting element 18 over a wide range of temperatures. In additional embodiments, coupling projection 26 may be formed integrally with cutting element 18 and/or a portion of cutting element 18. For example, a back portion of cutting element 18 (e.g., substrate 27 illustrated in FIG. 2) may be ground and/or otherwise shaped to form coupling projection 26 extending from back surface 19.

Cutting elements 18 may be coupled to bit body 12 using any suitable technique. For example, each cutting element 18 may be brazed, welded, soldered, threadedly coupled, and/or otherwise adhered and/or fastened to bit body 12. In at least one embodiment, back surface 19 of cutting element 18 may be brazed to mounting surface 21 and/or coupling projection 26 may be brazed to a surface of bit body 12 defining coupling recess 28. Any suitable brazing and/or or welding material and/or technique may be used to attach cutting element 18 to bit body 12. For example, cutting element 18 may be brazed to bit body 12 using a suitable braze filler material, such as, for example, an alloy comprising silver, tin, zinc, copper, palladium, nickel, and/or any other suitable metal compound.

In at least one embodiment, coupling projection 26 may be adhered to cutting element 18 using a brazing technique, as described above. Subsequently, cutting element 18 may be brazed to bit body 12 using a lower temperature brazing technique, thereby preventing separation of coupling projection 26 from cutting element 18 during the brazing process. A lower temperature brazing technique may involve temperatures of below approximately 1400° F. In some embodiments, cutting element 18 may be mechanically fastened to bit body 12. For example, coupling projection 26 may comprise a threaded exterior corresponding to a threaded portion of bit body 12 defining coupling recess 28. Cutting element 18 may also be bonded to bit body 12 using an adhesive, such as a polymeric adhesive. In at least one embodiment, coupling projection 26 may be secured within coupling recess 28 by an interference fit.

According to various embodiments, a shim may be positioned between at least a portion of back surface 19 of cutting element 18 and at least a portion of mounting surface 21 of bit body 12. In some embodiments, the shim may comprise a thermally conductive material, such as copper and/or any other suitable type of conductive metal, providing increased thermal conductivity between cutting element 18 and bit body 12. The shim may also create additional surface contact between cutting element 18 and bit body 12. Increased thermal conductivity and surface contact between cutting element 18 and bit body 12 may increase the transfer of excess heat from cutting element 18 and bit body 12, effectively dispersing excess heat generated in cutting element 18 during drilling. The shim may also reduce residual stresses between cutting element 18 and an adjacent material following brazing and/or welding. In at least one embodiment, a shim may be wedged between coupling projection 26 and a portion of bit body 12 defining coupling recess 28, thereby securely holding coupling projection 26 within coupling recess 28.

When cutting element 18 is coupled to bit body 12, coupling projection 26 may be secured within coupling recess 28, preventing separation of cutting element 18 from bit body 12. For example, when drill bit 10 is rotated relative to a rock formation during drilling, coupling projection 26 may be secured within coupling recess 28, thereby restricting one or more degrees of freedom of movement of cutting element 18 relative to bit body 12. Accordingly, coupling projection 26 and/or coupling recess 28 may resist various forces and stresses that cutting element 18 is subjected to during drilling, preventing separation of cutting element 18 from bit body 12.

Figure 2:
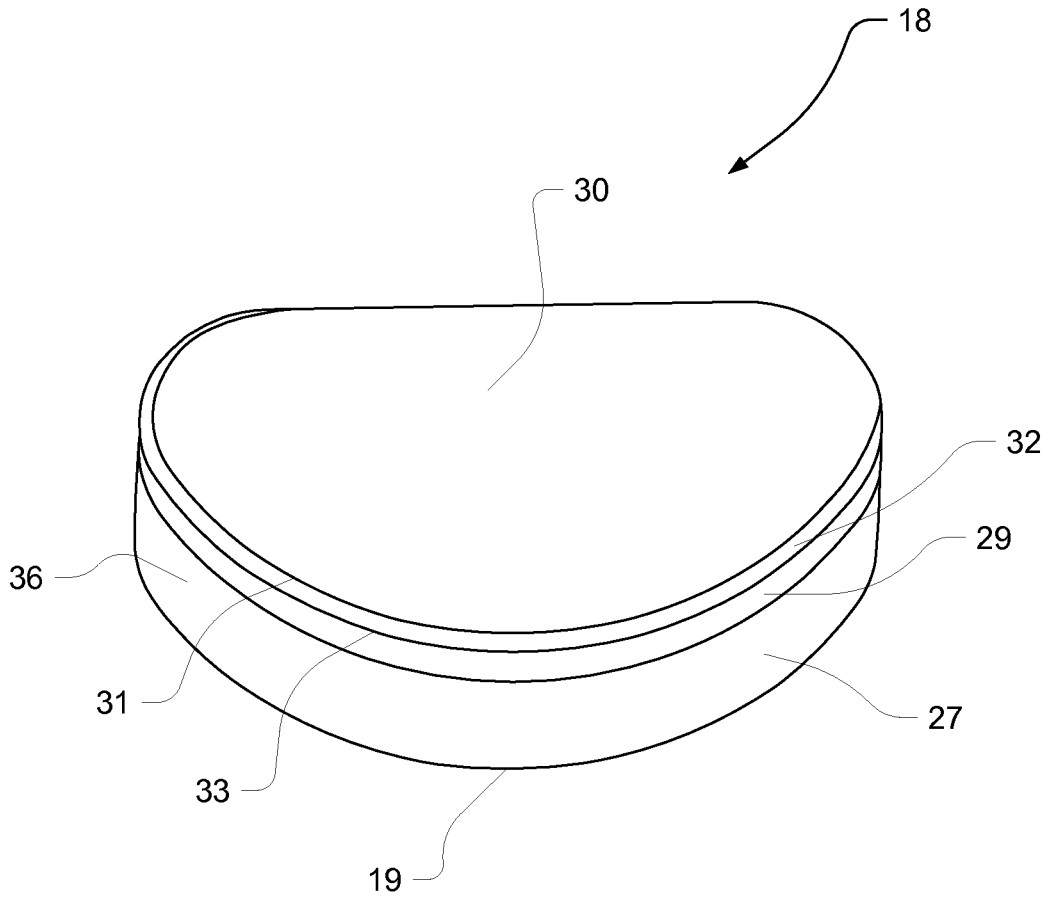
FIG. 2 is a perspective view of an exemplary cutting element according to at least one embodiment.

FIG. 2 is a perspective view of an exemplary cutting element 18 that may be coupled to a drill bit, such as exemplary bit body 12 in FIG. 1. As illustrated in FIG. 2, cutting element 18 may comprise a layer or table 29 affixed to or formed upon a substrate 27. Table 29 may be formed of any material or combination of materials suitable for cutting mining formations, including, for example, a superhard or superabrasive material such as polycrystalline diamond (PCD). The term "superhard," as used herein, may refer to any material having a hardness that is at least equal to a hardness of tungsten carbide. Similarly, substrate 27 may comprise any material or combination of materials capable of adequately supporting a superabrasive material during drilling of a mining formation, including, for example, cemented tungsten carbide. In at least one embodiment, cutting element 18 may comprise a table 29 comprising polycrystalline diamond bonded to a substrate 27 comprising cobalt-cemented tungsten carbide.

After forming table 29, a catalyst material (e.g., cobalt or nickel) may be at least partially removed from table 29. A catalyst material may be removed from table 29 using any suitable technique, such as, for example, acid leaching. In some embodiments, table 29 may be exposed to a leaching solution until a catalyst material is substantially removed from table 29 to a desired depth relative to one or more surfaces of table 29. In at least one embodiment, substrate 37 may be at least partially covered with a protective layer, such as, for example, a polymer cup, to prevent corrosion of substrate 27 during leaching. In additional embodiments, table 29 may be separated from substrate 27 prior to leaching table 29. For example, table 29 may be removed from substrate 27 and placed in a leaching solution so that all surfaces of table 29 are at least partially leached. In various embodiments, table 29 may be reattached to substrate 27 or attached to a new substrate 27 following leaching. Table 29 may be attached to substrate 27 using any suitable technique, such as, for example, brazing, welding, or HPHT processing.

As shown in FIG. 2, cutting element 18 may also comprise a cutting face 30 formed by table 29, a side surface 36 formed by table 29 and substrate 27, and a back surface 19 formed by substrate 27. According to various embodiments, cutting face 30 may be substantially planar and side surface 36 may be substantially perpendicular and/or sloped relative to cutting face 30. Back surface 19 may be opposite and, in some embodiments, substantially parallel to cutting face 30.

Cutting face 30 and side surface 36 may be formed in any suitable shape, without limitation. In one embodiment, cutting face 30 may have a substantially arcuate periphery. In another embodiment, cutting face 30 may have a substantially semi-circular periphery. For example, two cutting elements 18 may be cut from a single substantially circular cutting element blank, resulting in two substantially semi-circular cutting elements 18. In some embodiments, cutting element 18 may include one or more angular portions, projections, and/or recesses, without limitation. In at least one embodiment, angular portions of side surface 26 may be rounded to form a substantially arcuate surface around cutting element 18. Cutting element 18 may also comprise any other suitable shape and/or configuration, without limitation, as will be discussed in greater detail below.

As illustrated in FIG. 2, cutting element 18 may also comprise a chamfer 32 formed along at least a portion of a periphery of table 29 between cutting face 30 and side surface 36. In some embodiments, and as illustrated FIG. 2, table 29 may include a chamfer 32. Table 29 may also include any other suitable surface shape between cutting face 30 and side surface 36, including, without limitation, an arcuate surface, a radius, a sharp edge, and/or a honed edge. Chamfer 32 may be configured to contact and/or cut a mining formation as drill bit 10 is rotated relative to the formation. In at least one embodiment, the phrase "cutting edge" may refer to an edge portion of cutting element 18 that is exposed to and/or in contact with a formation during drilling. In some embodiments, cutting element 18 may comprise one or more cutting edges, such as an edge 31 and/or or an edge 33, as shown in FIG. 2. Edge 31 and/or edge 33 may be formed adjacent chamfer 32 and may be configured to be exposed to and/or in contact with a mining formation during drilling.

Figure 3A:
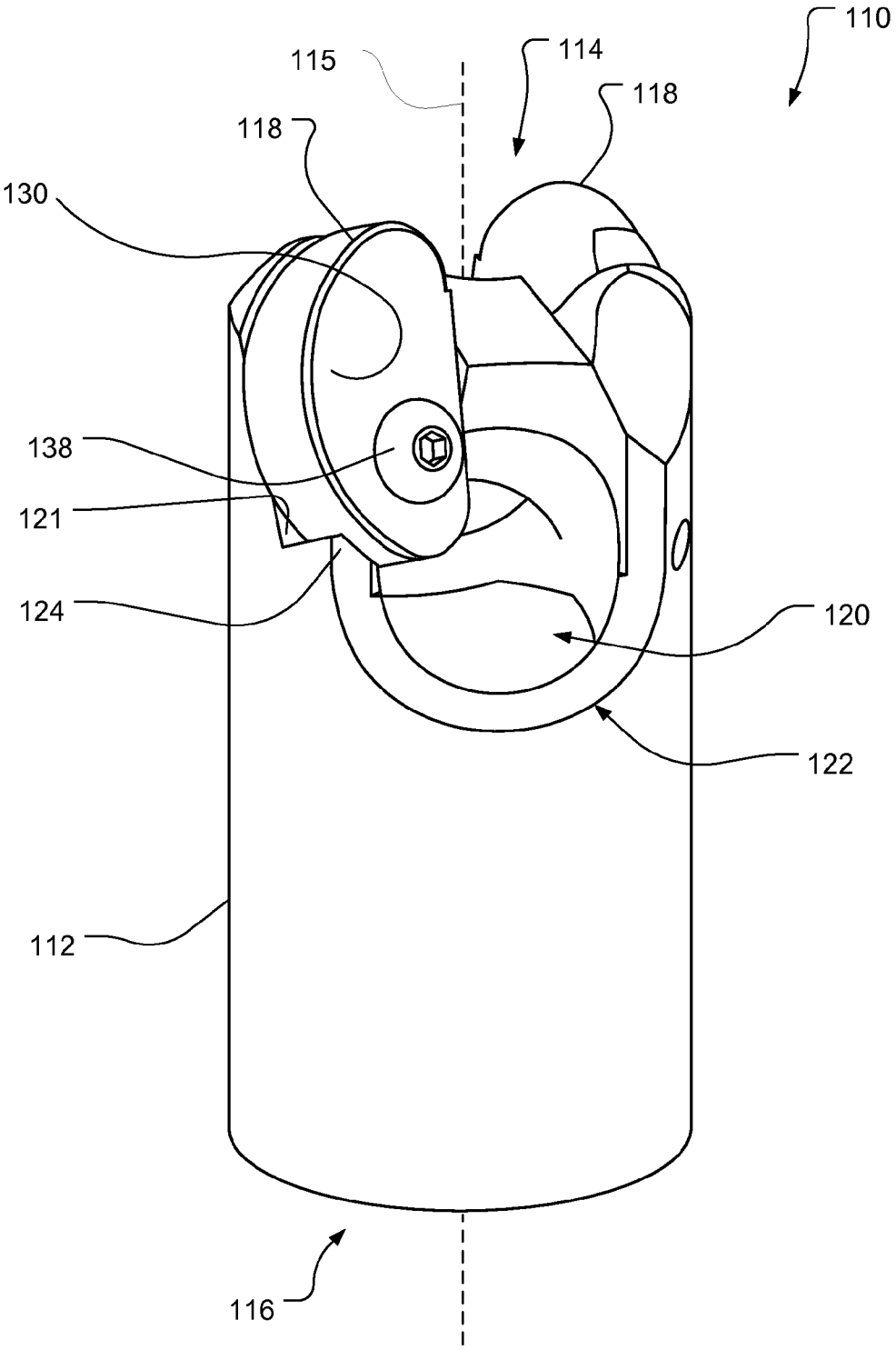
FIG. 3A is a perspective view of an exemplary drill bit according to at least one embodiment.
Figure 3B:
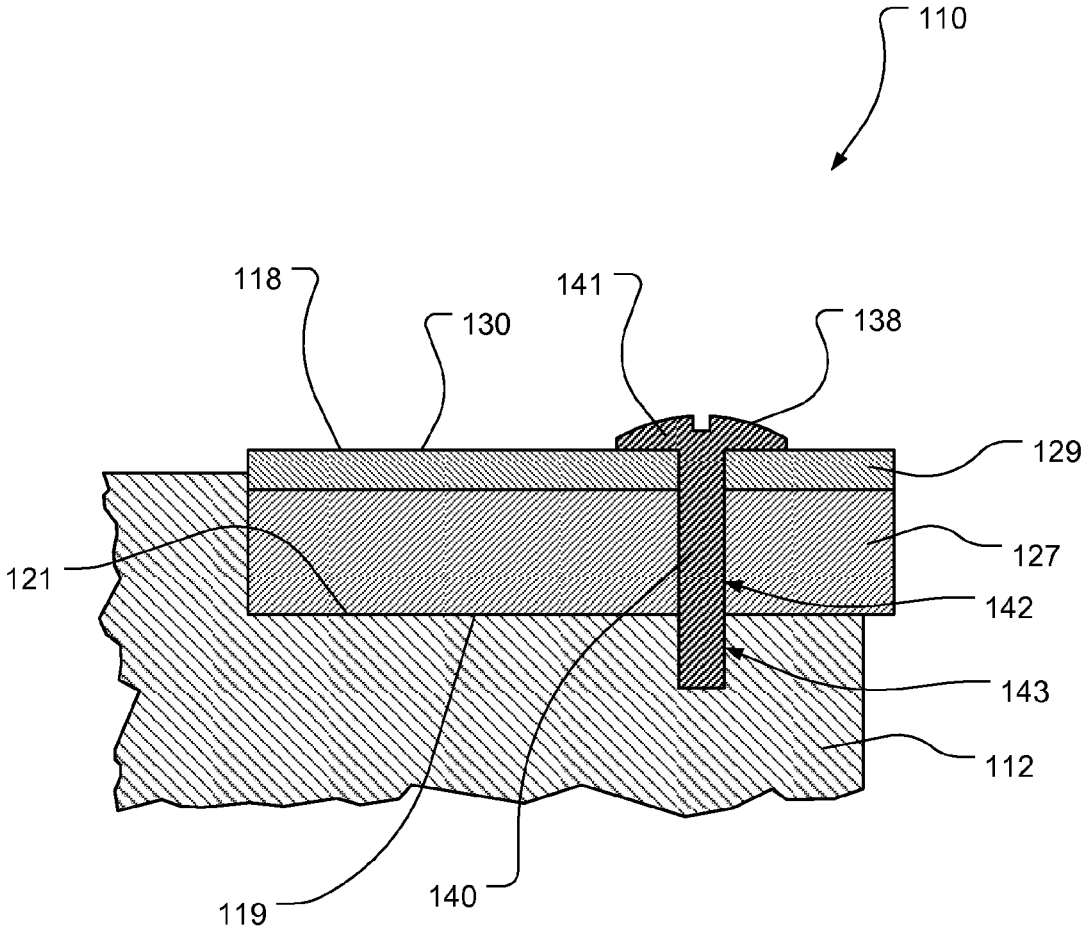
FIG. 3B is a cross-sectional view of a portion of the exemplary drill bit illustrated in FIG. 3A.

FIGS. 3A and 3B illustrate an exemplary drill bit 110 according to at least one embodiment. FIG. 3A is a perspective view of exemplary drill bit 110 and FIG. 3B is a cross-sectional view of a portion of exemplary drill bit 110. As illustrated in FIGS. 3A and 3B, drill bit 110 may comprise a bit body 112 having a forward end 114 and a rearward end 116. Drill bit 110 may be rotatable about a central axis 115. An internal passage 120 and at least one side opening 122 may be defined in bit body 112. Bit body 112 may also include at least one support member 124.

At least one cutting element 118 may be coupled to bit body 112. For example, a back surface 119 of each cutting element 118 may be mounted to a mounting surface 121 of bit body 112. According to some embodiments, each cutting element 118 may be secured to bit body 112 by a coupling attachment 138. As illustrated in FIG. 3B, coupling attachment 138 may comprise a coupling projection 140 and an abutment portion 141. Coupling projection 140 may be configured to extend through cutting element 118 and into at least a portion of bit body 112. For example, coupling projection 140 may extend through an opening 142 defined in cutting element 118 and into a coupling recess 143 defined in bit body 112. Abutment portion 141 may be positioned adjacent to a surface portion of cutting element 118, such as a portion of cutting surface 130.

In at least one embodiment, abutment portion 141 of coupling attachment 138 may be positioned adjacent to and/or abutting cutting face 130 of cutting element 118. Additionally, coupling projection 140 may extend through opening 142, which is defined in table 129 and substrate 127 of cutting element 118, and at least partially into coupling recess 143, which may be defined in bit body 112 inward from mounting surface 121. According various embodiments, coupling attachment 138 may enable cutting element 118 to be secured to bit body 112 without brazing or otherwise adhering cutting element 118 to bit body 112. According to at least one embodiment, a washer, plate, and/or other suitable layer may be disposed between abutment portion 141 of coupling attachment 138 and cutting surface 130 of cutting element 118. The washer, plate, or layer may spread contact pressure over a larger portion of cutting surface 130 when coupling attachment 138 is secured to bit body 112.

In some embodiments, a shim may be positioned between at least a portion of back surface 119 of cutting element 118 and at least a portion of mounting surface 121 of bit body 112. In at least one embodiment, the shim may facilitate heat transfer between cutting element 118 and bit body 112. Increased heat transfer between cutting element 118 and bit body 112 may increase the transfer of excess heat from cutting element 118 and bit body 112, effectively dispersing heat generated in cutting 118 during drilling.

Coupling projection 140 may be secured within coupling recess 143 using any suitable attachment technique. For example, coupling projection 140 may be threadedly coupled to bit body 112. Coupling projection 140 of coupling attachment 138 may be threadedly driven into coupling recess 143 in bit body 112 until abutment portion 141 of coupling attachment 138 securely abuts cutting face 130 of cutting element 118 and back surface 119 of cutting element 118 securely abuts mounting surface 121 of bit body 112. In additional embodiments, coupling attachment 138 may couple cutting element 118 to bit body 112 using any suitable fastening and/or attachment technique. For example, an adhesive compound may be used to secure coupling projection 140 of coupling attachment 138 within coupling recess 143 of bit body 112.

Figure 4:
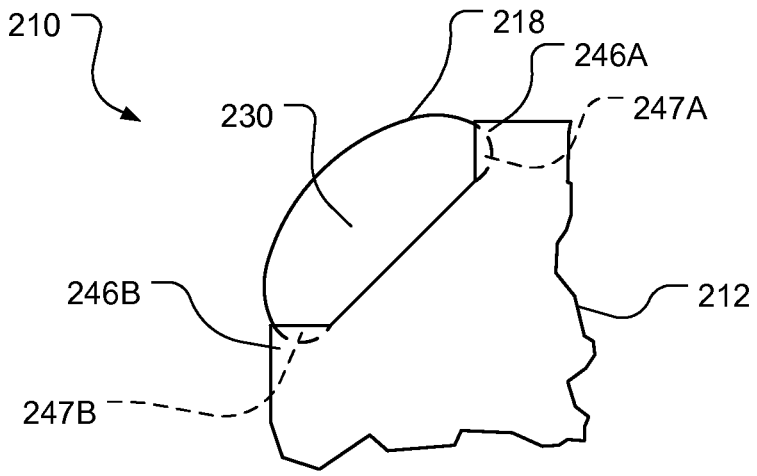
FIG. 4 is a side view of a portion of an exemplary drill bit according to at least one embodiment.
Figure 5:
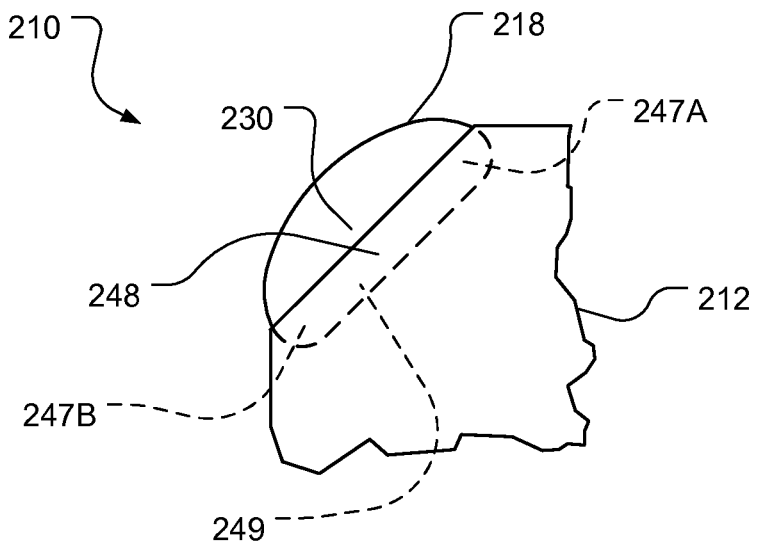
FIG. 5 is a side view of a portion of an exemplary drill bit according to at least one embodiment.

FIGS. 4 and 5 show portions of exemplary drill bits according to various embodiments. As shown in FIGS. 4 and 5, drill bit 210 may include at least one cutting element 218 mounted to a bit body 212. Cutting element 218 may be mounted to any suitable portion of bit body 212, such as a mounting surface (e.g., mounting surface 21 illustrated in FIG. 1). Drill bit 210 may also include features from one or more of the exemplary embodiments described herein, without limitation.

As shown in FIG. 4, cutting element 218 may comprise a cutting face 230 and at least one corner region, such as corner regions 247A and 247B. Corner regions 247A and 247B may comprise generally angular and/or rounded corner portions of cutting element 218. In some embodiments, corner regions 247A and 247B may be formed between two or more side surface portions of cutting element 218. Bit body 212 may comprise at least one corner overlap portion corresponding to at least one of corner regions 247A and 247B. For example, bit body 212 may comprise a corner overlap portion 246A that corresponds to corner region 247A and a corner overlap portion 246B that corresponds to corner region 247B of cutting element 218.

According to some embodiments, cutting element 218 may be positioned on bit body 212 so that corner regions 247A and/or 247B are at least partially overlapped by corner overlap portions 246A and/or 246B of bit body 212. For example, as shown in FIG. 4, cutting element 218 may be positioned on bit body 212 so that corner overlap regions 246A and 246B are positioned adjacent to and/or abutting corner regions 247A and 247B that include at least a portion of cutting face 230 of cutting element 218. Corner overlap regions 246A and 246B may facilitate coupling of cutting element 218 to bit body 212. Additionally, corner overlap regions 246A and 246B may restrict one or more degrees of freedom of movement of cutting element 218 relative to bit body 212 during drilling. Accordingly, cutting element 218 may be secured to bit body 212 so as to resist various forces and stresses that cutting element 218 is subjected to during drilling, preventing separation of cutting element 218 from bit body 212.

As illustrated in FIG. 5, cutting element 218 may also comprise at least one side region, such as side region 249. Side region 249 may comprise a side portion of cutting element 218, such as a portion of cutting element 218 extending between corner regions (e.g., corner regions 274A and 247B illustrated in FIG. 4) of cutting element 218. Bit body 212 may also comprise a side overlap portion 248 corresponding to side region 249 of cutting element 218.

According to some embodiments, cutting element 218 may be positioned on bit body 212 so that side region 249 is at least partially overlapped by side overlap portion 248 of bit body 212. For example, as shown in FIG. 5, cutting element 218 may be positioned on bit body 212 so that side overlap portion 248 of bit body 212 is positioned adjacent to and/or abutting at least a portion of side region 249 that includes cutting face 230 of cutting element 218. Side overlap portion 248 of bit body 218 may facilitate coupling of cutting element 218 to bit body 212. Additionally, side overlap portion 248 may restrict one or more degrees of freedom of movement of cutting element 218 relative to bit body 212 during drilling. Accordingly, cutting element 218 may be secured to bit body 212 so as to resist various forces and stresses that cutting element 218 is subjected to during drilling, preventing separation of cutting element 218 from bit body 212.

Figure 6A:
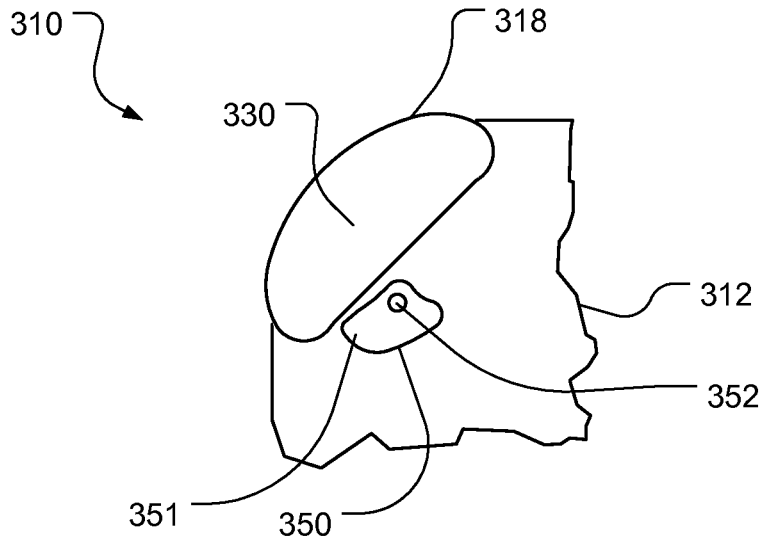
FIG. 6A is a side view of a portion of an exemplary drill bit according to at least one embodiment.
Figure 6B:
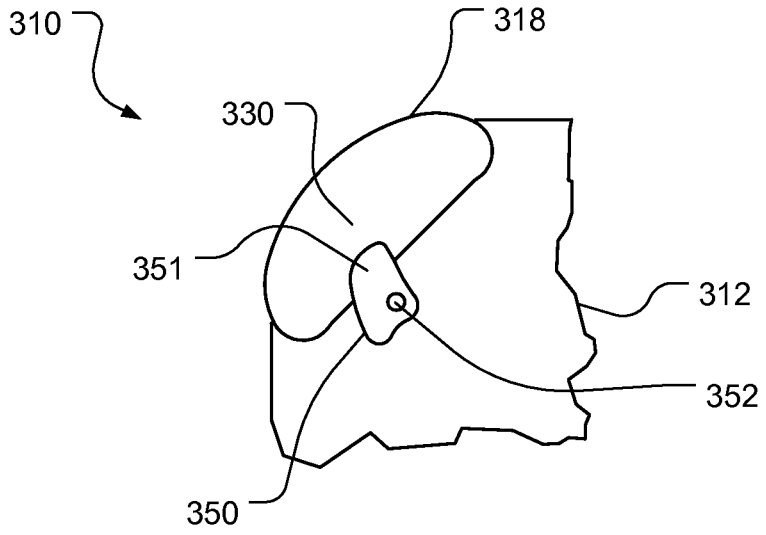
FIG. 6B is a side view of the portion of the exemplary drill bit illustrated in FIG. 6A.

FIGS. 6A and 6B show portions of an exemplary drill bit 310 according to at least one embodiment. As shown in FIGS. 6A and 6B, drill bit 310 may include at least one cutting element 318 mounted to a bit body 312. Cutting element 318 may be mounted to any suitable portion of bit body 312, such as a mounting surface (e.g., mounting surface 21 illustrated in FIG. 1).

As shown in FIGS. 6A and 6B, cutting element 318 may comprise a cutting face 330. Drill bit 310 may comprise at least one locking member, such as locking attachment 350, which is configured to further secure cutting element 318 to bit body 312. Locking attachment 350 may comprise a locking overlap portion 351 configured to overlap at least a portion of cutting element 318. Additionally, locking attachment 350 may be rotatably coupled to bit body 312 by pivot member 352.

According to at least one embodiment, locking attachment 350 may be movable between an unlocked position and a locked position. For example, FIG. 6A shows locking attachment 350 in an unlocked position. When locking attachment 350 is positioned in the unlocked position, locking overlap portion 351 may not overlap an area where cutting element 318 is to be mounted. Accordingly, cutting element 318 may be mounted and positioned on bit body 312 when locking attachment 350 is in the unlocked position.

FIG. 6B shows locking attachment 350 in a locked position. Locking attachment 350 may be rotated about pivot member 352 between the unlocked position and the locked position. As illustrated in FIG. 6B, when locking attachment 350 is in the locked position, locking overlap portion 351 of locking attachment 350 may overlap and/or contact at least a portion of cutting element 318. For example, locking overlap portion 351 of locking attachment 350 may be positioned adjacent to and/or abutting a portion of cutting face 330 of cutting element 318. Locking attachment 350 may facilitate coupling of cutting element 318 to bit body 312 when locking attachment 350 is in the locked position. Additionally, locking overlap portion 351 of locking attachment 350 may restrict one or more degrees of freedom of movement of cutting element 318 relative to bit body 312 during drilling. Accordingly, cutting element 318 may be secured to bit body 312 so as to resist various forces and stresses that cutting element 318 is subjected to during drilling, preventing separation of cutting element 318 from bit body 312.

Figure 7A:
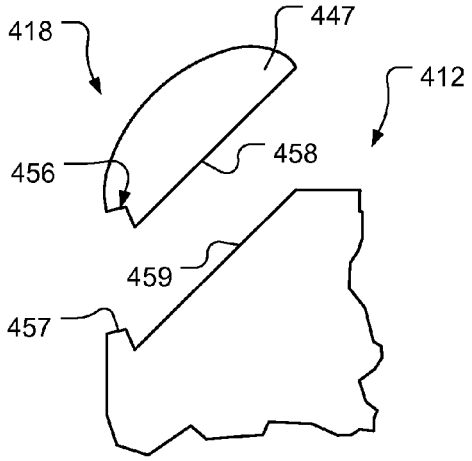
FIG. 7A is a side view of a portion of an exemplary bit body and cutting element according to at least one embodiment.

FIGS. 7A-8B show portions of exemplary drill bits according to various embodiments. FIGS. 7A-7B illustrate a drill bit 410 that includes at least one cutting element 418 mounted to a bit body 412. Cutting element 418 may be mounted to any suitable portion of bit body 412, such as a mounting surface (e.g., mounting surface 21 illustrated in FIG. 1).

Figure 7B:
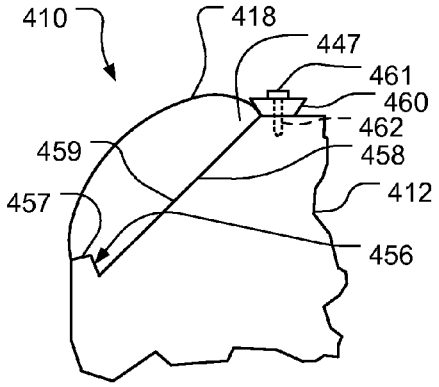
FIG. 7B is a side view of a portion of an exemplary drill bit that includes the bit body and cutting element illustrated in FIG. 7A.

As shown in FIGS. 7A and 7B, cutting element 418 may comprise a cutting face 430 and at least one corner region, such as corner region 447. At least one coupling recess, such as first coupling recess 456, may be defined in a portion of cutting element 418. First coupling recess 456 may be formed to any suitable shape and may be configured to fit around a corresponding coupling projection 457 extending from a portion of bit body 412. For example, first coupling recess 456 of cutting element 418 may be shaped to at least partially surround and/or interlock with coupling projection 457 of bit body 412 when cutting element 418 is mounted to bit body 412.

In some embodiments, drill bit 410 may also comprise a coupling attachment 460 that is configured to further secure cutting element 418 to bit body 412. For example, as illustrated in FIG. 7B, drill bit 410 may include a coupling attachment 460 that is attached to the bit body 412 by a fastener 461. Fastener 461 may include a fastener projection 462 that extends through fastener 461 and into bit body 412. For example, fastener projection 462 may comprise a threaded projection that is threadedly secured to bit body 412. In some embodiments, fastener projection 462 may be secured to bit body 412 by an interference fit. Coupling attachment 460 may be positioned adjacent to and/or abutting a portion of cutting element 418. For example, coupling attachment 460 may contact a side portion of cutting element 418 that is generally opposite first coupling recess 456, as illustrated in FIG. 7B.

When coupling attachment 460 is secured to bit body 412 by fastener 461, coupling attachment 460 may exert force against cutting element 418 in a direction generally toward coupling projection 457 and/or other portions of bit body 412 such that first coupling recess 456 of cutting element 418 securely abuts coupling projection 457 of bit body 412. Additionally, coupling attachment 460 and/or coupling projection 457 may restrict one or more degrees of freedom of movement of cutting element 418 relative to bit body 412 during drilling. Accordingly, cutting element 418 may be secured to bit body 412 so as to resist various forces and stresses that cutting element 418 is subjected to during drilling, preventing separation of cutting element 418 from bit body 412.

Figure 8A:
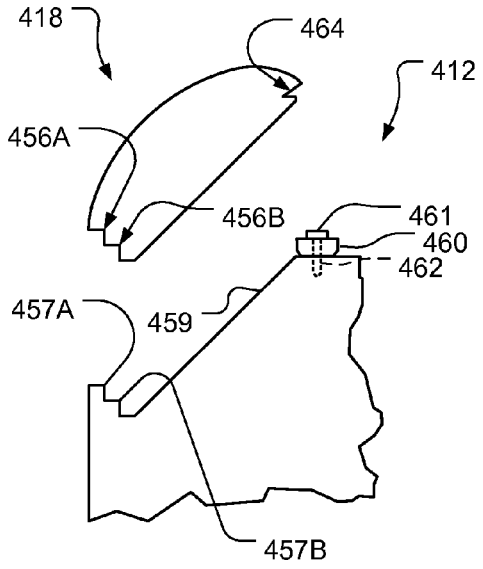
FIG. 8A is a side view of a portion of an exemplary bit body and cutting element according to at least one embodiment.
Figure 8B:
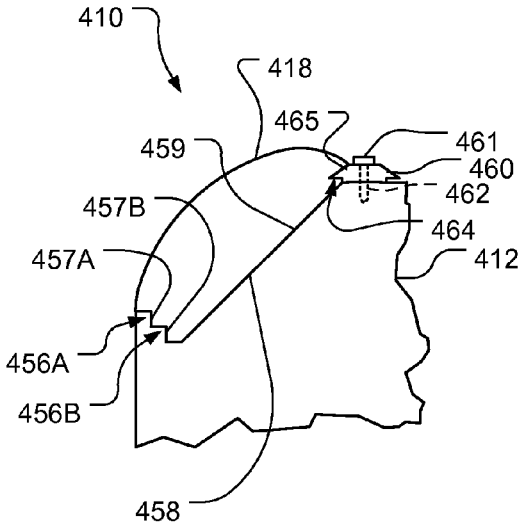
FIG. 8B is a side view of a portion of an exemplary drill bit that includes the bit body and cutting element illustrated in FIG. 8A.

In some embodiments, a plurality of coupling recesses may be defined in cutting element 418. For example, as illustrated in FIGS. 8A and 8B, cutting element 418 may comprise first coupling recesses 456A and 456B defined in a first region of cutting element 418 and a second coupling recess 464 defined in a second region of cutting element 418 that is generally opposite the first region. First coupling recesses 456A and 456B may be formed to any suitable shape and may be configured to fit around corresponding coupling projections 457A and 457B extending from a portion of bit body 412. For example, first coupling recesses 456A and 456B of cutting element 418 may be shaped to at least partially surround and/or interlock with coupling projections 457A and 457B of bit body 412 when cutting element 418 is mounted to bit body 412.

As illustrated in FIGS. 8A and 8B, drill bit 410 may also comprise a coupling attachment 460 that is configured to further secure cutting element 418 to bit body 412. As illustrated in FIGS. 8A and 8B, coupling attachment 460 may be movable between an unlocked position and a locked position. FIG. 8A shows coupling attachment 460 in an unlocked position. When coupling attachment 460 is positioned in the unlocked position, coupling attachment 460 may not overlap an area where cutting element 418 is positioned on bit body 412. Accordingly, cutting element 418 may be mounted and positioned on bit body 412 when coupling attachment 460 is in the unlocked position.

FIG. 8B shows coupling attachment 460 in a locked position. Coupling attachment 460 may be rotated about fastener projection 462 between the unlocked position and the locked position. As illustrated in FIG. 8B, when coupling attachment 460 is in the locked position, a portion of coupling attachment 460 may be positioned within second coupling recess 464 of cutting element 418. For example, a portion of coupling attachment 460 may be positioned within second coupling recess 464 abutting one or more surfaces of cutting element 418 defining second coupling recess 464. Coupling attachment 460 may securely hold cutting element 418 against coupling projections 457A and/or 457B of bit body 412 when coupling attachment 460 is in the locked position. Additionally, coupling attachment 460, coupling projection 457A, and/or coupling projection 457B may restrict one or more degrees of freedom of movement of cutting element 418 relative to bit body 412 during drilling. Accordingly, cutting element 418 may be secured to bit body 412 so as to resist various forces and stresses that cutting element 418 is subjected to during drilling, preventing separation of cutting element 418 from bit body 412.

Figure 9A:
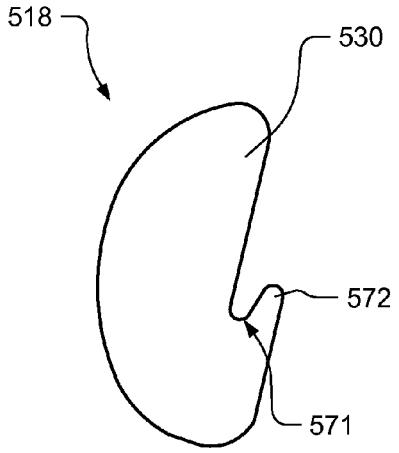
FIG. 9A is a top view of an exemplary cutting element according to at least one embodiment.
Figure 9B:
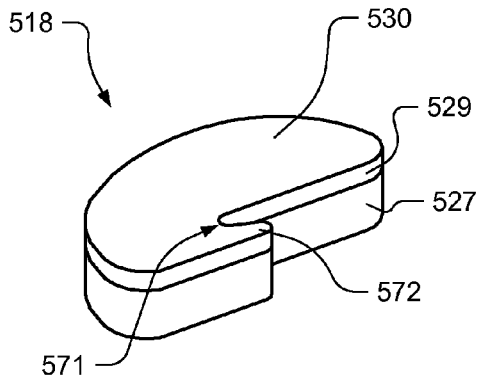
FIG. 9B is a perspective view of the exemplary cutting element illustrated in FIG. 9A.
Figure 9C:
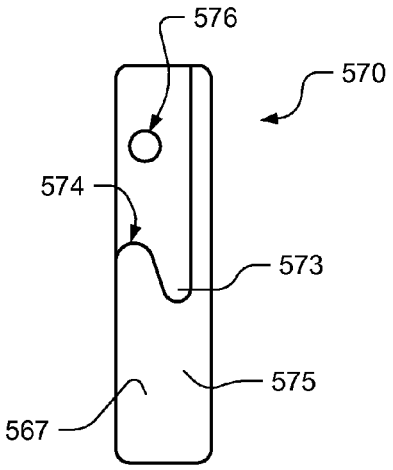
FIG. 9C is a bottom view of an exemplary coupling attachment for securing the exemplary cutting element illustrated in FIG. 9A to a drill bit according to at least one embodiment.
Figure 9D:
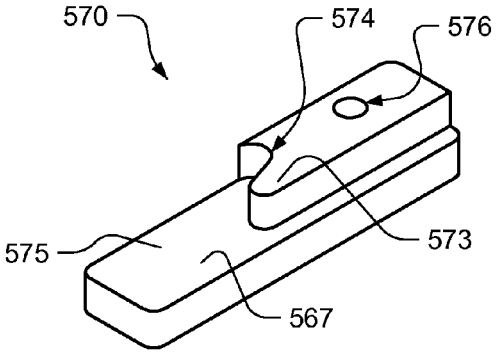
FIG. 9D is a perspective view of the exemplary coupling attachment illustrated in FIG. 9C.
Figure 9E:
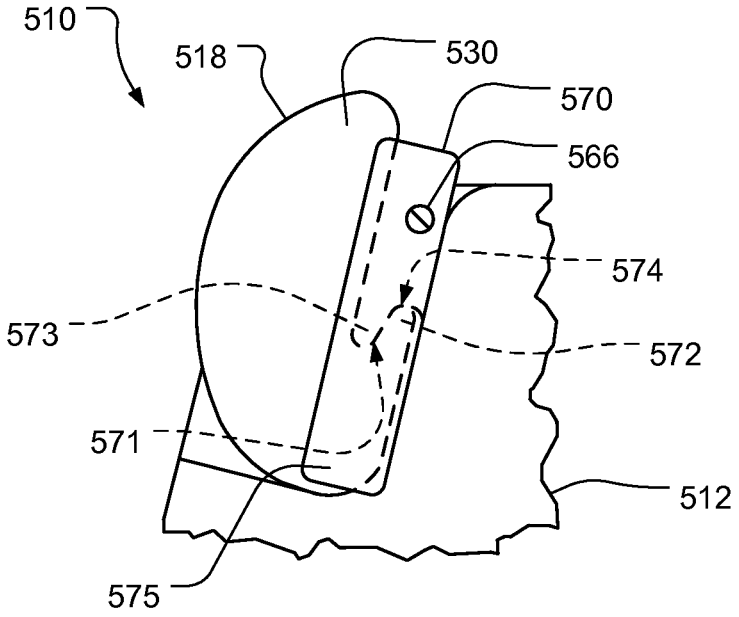
FIG. 9E is a side view of a portion of an exemplary drill bit assembly that includes the cutting element and coupling attachment illustrated in FIGS. 9A-9D.

FIGS. 9A-9E show portions of an exemplary drill bit 510 according to at least one embodiment. FIGS. 9A and 9B illustrate a cutting element 518 and FIGS. 9C and 9D illustrate a coupling attachment 570 configured to secure cutting element 518 to a bit body of a drill bit. FIG. 9E illustrates a drill bit 510 that includes cutting element 518 and coupling attachment 570 secured to a bit body 512. Cutting element 518 may be mounted to any suitable portion of bit body 512, such as a mounting surface (e.g., mounting surface 21 illustrated in FIG. 1).

As shown in FIGS. 9A and 9B, cutting element 518 may comprise a cutting face 530 and a cutting element projection 572. A cutting element recess 571 may also be defined in a portion of cutting element 518, such as a region of cutting element 518 near cutting element projection 572. Cutting element recess 571 and/or cutting element projection 572 may be shaped and configured to abut and/or interlock with at least a portion of coupling attachment 570 when cutting element 518 is mounted to bit body 512.

As shown in FIGS. 9C and 9D, coupling attachment 570 may comprise an attachment projection 573 and an overlap region 575. Overlap region 575 may include a cutting face contact surface 567 that is configured to abut a portion of cutting face 530 of cutting element 518 when cutting element 518 is mounted to bit body 512. An attachment recess 574 may be defined in a portion of coupling attachment 570, such as a region of coupling attachment 570 near attachment projection 573. Attachment projection 573 and attachment recess 574 of coupling attachment 570 may be shaped and configured to abut and/or interlock with at least a portion of cutting element 518, such as cutting element recess 571 and/or cutting element projection 572, when cutting element 518 is mounted to bit body 512. According to at least one embodiment, attachment projection 573 and attachment recess 574 may extend outward from a surface of coupling attachment 570, such as a surface of overlap region 575. An opening 576 may also be defined in a portion of coupling attachment 570.

As illustrated in FIG. 9E, cutting element 518 may be mounted to bit body 512 and coupling attachment 570 may overlap at least a portion of cutting element 518 and/or bit body 512. For example, overlap region 575 of coupling attachment 570 may be positioned adjacent to and/or abutting at least a portion of cutting element 518, such as a portion of cutting face 530. In some examples, a cutting face contact surface of coupling attachment 570 (e.g., cutting face contact surface 567 illustrated in FIGS. 9C and 9D) may abut at least a portion of cutting face 530 of cutting element 518. In at least one embodiment, at least a portion of coupling attachment 570 may interlock with at least a portion of cutting element 518. For example, coupling attachment 570 may be disposed over bit body 512 and cutting element 518 so that attachment projection 573 of coupling attachment 570 is disposed within and/or abutting cutting element recess 571 of cutting element 518, and so that cutting element projection 572 of cutting element 518 is disposed within and/or abutting attachment recess 574 of coupling attachment 570.

In some embodiments, coupling attachment 570 and/or cutting element 518 may be secured to bit body 512 by a fastener 566. Fastener 566 may comprise any suitable type of fastening member configured to secure coupling attachment 570 and/or cutting element 518 to bit body 512, such as, for example, a threaded attachment member. According to at least one embodiment, fastener 566 may comprise a projecting portion, such as a threaded projecting portion, extending through opening 576 and into a corresponding recess defined in bit body 512. In some embodiments fastener 566 may be secured to bit body 512 by an interference fit, braze, weld, or other suitable securement technique, without limitation.

When coupling attachment 570 is secured to bit body 512 by fastener 566, coupling attachment 570 may exert force against cutting face 530 of cutting element 518 in a direction generally toward a portion of bit body 512, such as a mounting surface (e.g., mounting surface 21 illustrated in FIG. 1), so that cutting element 518 is securely held against bit body 512 and/or so that coupling attachment 570 and cutting element 518 are securely interlocked with each other. Coupling attachment 570 may restrict one or more degrees of freedom of movement of cutting element 518 relative to coupling attachment 570 and/or bit body 512 during drilling. Accordingly, cutting element 518 may be secured to bit body 512 so as to resist various forces and stresses that cutting element 518 is subjected to during drilling, preventing separation of cutting element 518 from bit body 512.

Figure 10A:
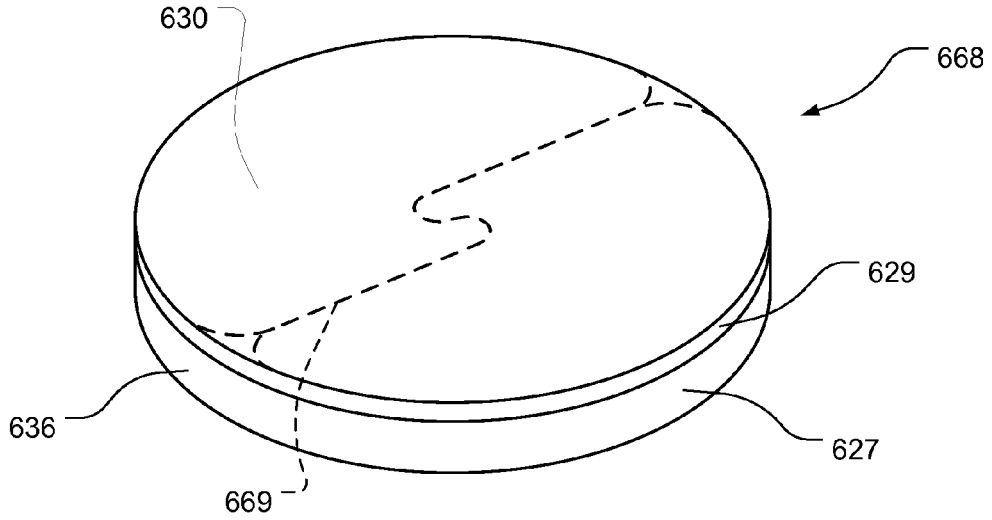
FIG. 10A is a perspective view of a cutting element blank used to form at least one cutting element according to at least one embodiment.
Figure 10B:
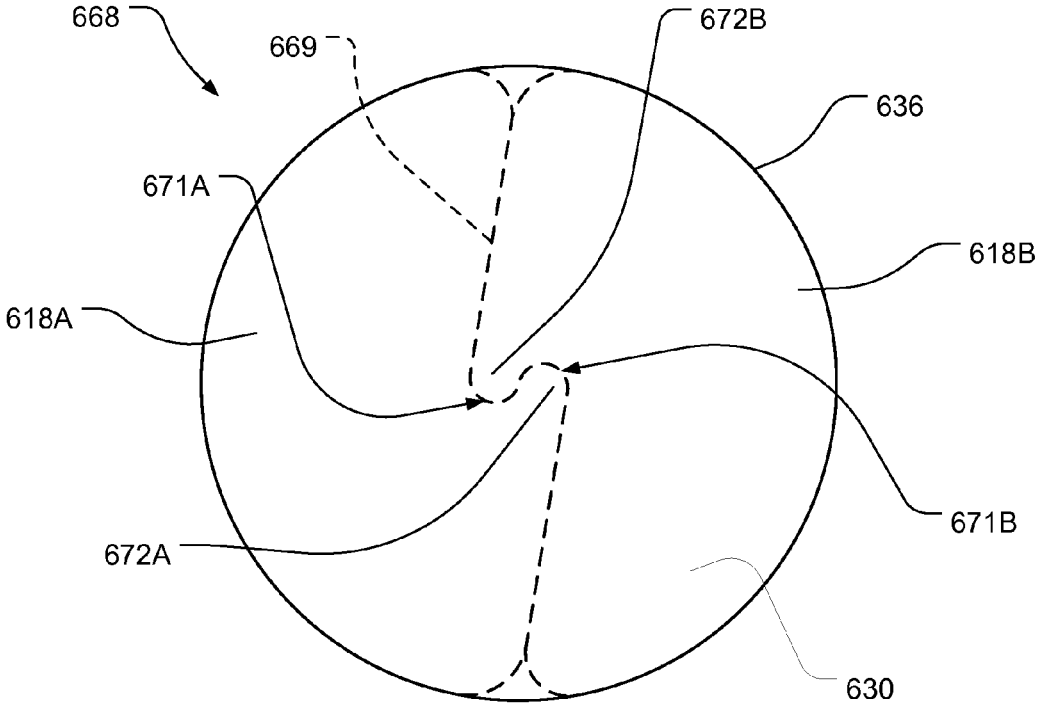
FIG. 10B is a top view of the cutting element blank illustrated in FIG. 10A.

FIGS. 10A and 10B show a cutting element blank used to form cutting elements according to at least one embodiment. As shown in FIGS. 10A and 10B, cutting element blank 668 may comprise a substrate 27 and a table 29 defining a cutting face 630 and a side surface 636. According to some embodiments, cutting element blank 668 may comprise a substantially cylindrical volume. Cutting element blank 668 may also comprise any other suitable shape, without limitation.

Cutting element blank 668 may be divided into two or more cutting elements. For example, cutting element blank 668 may be divided along cutout line 669 to form two cutting elements 618A and 618B. Cutting element blank 668 may be divided into cutting elements 618A and 618B using any suitable technique, such as, for example, a wire-electrical-discharge machining ("wire EDM") process. Cutting elements 618A and 618B may be divided so as to form projections and/or recesses for coupling and/or securing cutting elements 618A and/or 618B to a bit body (e.g., bit body 512 illustrated in FIG. 9E). For example, as illustrated in FIGS. 10A and 10B, cutting element 618A may cut from cutting element blank 668 so as to form a cutting element recess 671A and a cutting element projection 672A, and cutting element 618B may cut from cutting element blank 668 so as to form a corresponding cutting element recess 671B and cutting element projection 672B. Cutting elements cut from cutting element blank 668 may also be cut and/or formed to any other suitable shape, without limitation.

Figure 11:
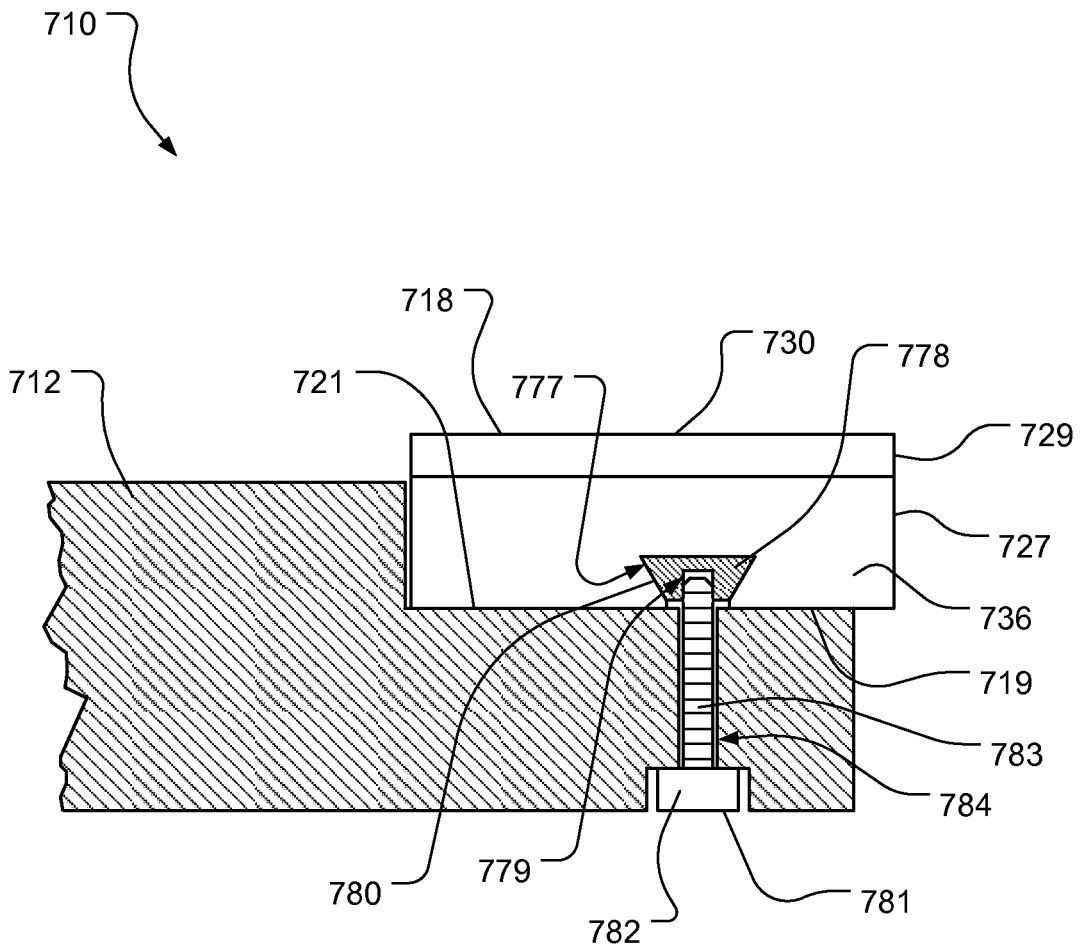
FIG. 11 is a partial cross-sectional side view of a portion of an exemplary drill bit according to at least one embodiment.

FIG. 11 is a partial cross-sectional view of a portion of an exemplary drill bit 710 according to certain embodiments. As illustrated in FIG. 11, drill bit 710 may include a bit body 712 and at least one cutting element 618 mounted to a mounting surface 721 of bit body 712.

Cutting element 718 may comprise a table 729 affixed to or formed upon a substrate 727. Cutting element 718 may also comprise a cutting face 730 formed by table 729 and a back surface 719 formed on an opposite side of cutting element 718 by substrate 727. In at least one embodiment, an insert slot 777 may be defined in a back portion of substrate 727. According to some embodiments, insert slot 777 may extend through at least a portion of cutting element 718. For example, insert slot 777 may comprise a dovetail slot or a T-slot extending through at least a portion of substrate 727. In at least one embodiment, insert slot 777 may extend from a dovetail-shaped or T-shaped opening defined in side surface 736 of cutting element 718 through at least a portion of substrate 727. Insert slot 777 may open toward a corresponding opening 784 defined within bit body 712. As illustrated in FIG. 10, opening 784 may extend through a portion of bit body 712 between mounting surface 721 and a surface of bit body 612 opposite mounting surface 721.

According to at least one embodiment, a coupling insert 778 may be disposed within insert slot 777. Coupling insert 778 may abut one or more surfaces defining insert slot 777. For example, coupling insert 778 may comprise a tapered surface 780 configured to contact a corresponding tapered surface defining insert slot 777 when coupling insert 778 is disposed within insert slot 777. According to some embodiments, a coupling recess 779 may be defined within coupling insert 778.

As illustrated in FIG. 11, drill bit 710 may also comprise a coupling attachment 781 extending through opening 784 defined within bit body 712. Coupling attachment 781 may be configured to secure cutting element 718 to bit body 712. According to at least one embodiment, coupling attachment 781 may comprise an abutment portion 782 and a coupling projection 783. As shown in FIG. 11, abutment portion 782 may contact a portion of bit body 712, such as a surface portion of bit body 712 facing generally away from cutting element 718. Coupling projection 783 may extend through opening 784 of bit body 712 and into at least a portion of coupling recess 779 defined within coupling insert 778.

Coupling projection 783 may be secured within coupling recess 779 of coupling insert 778 using any suitable attachment technique, without limitation. For example, coupling projection 783 may be threadedly coupled to coupling insert 778. In at least one embodiment, coupling projection 783 of coupling attachment 781 may be threadedly driven into coupling recess 779 such that an exterior surface of coupling insert 778, such as tapered surface 780, is forced against a corresponding surface portion of cutting element 718 defining insert slot 777. As tapered surface 780 of coupling insert 778 is forced against a surface portion of cutting element 718 defining insert slot 777, back surface 719 of cutting element 718 may be forced against mounting surface 721 of bit body 712.

In at least one embodiment, coupling attachment 781 may couple cutting element 718 to bit body 712 using any suitable fastening and/or attachment technique. For example, an adhesive compound may be used to secure coupling projection 783 of coupling attachment 781 within coupling recess 779 of coupling insert 778. In at least one embodiment, coupling insert 778 may comprise a different material than cutting element 718. For example, substrate 727 of cutting element 718 may comprise a carbide material, such as tungsten carbide, and coupling insert 778 may comprise a material suitable for coupling to coupling attachment 781, such as a metal, a ceramic, and/or a polymeric material, without limitation. Coupling attachment 781 may restrict one or more degrees of freedom of movement of cutting element 718 during drilling. Accordingly, cutting element 718 may be secured to bit body 712 so as to resist various forces and stresses that cutting element 718 is subjected to during drilling, preventing separation of cutting element 718 from bit body 712.

Figure 12A:
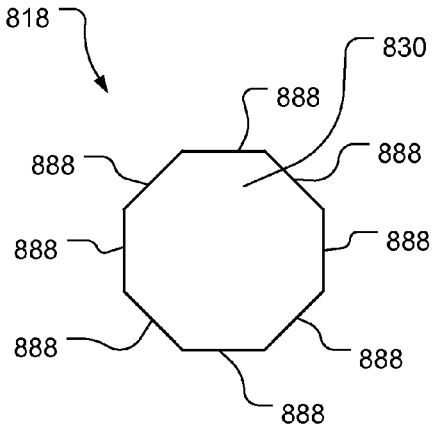
FIG. 12A is a top view of an exemplary cutting element according to at least one embodiment.
Figure 12B:
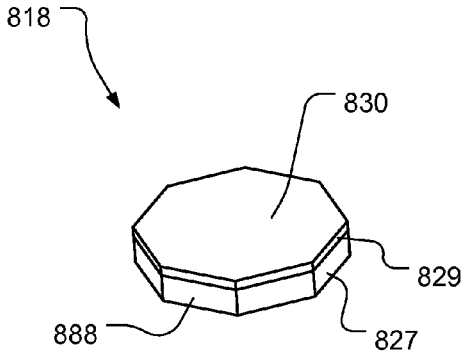
FIG. 12B is a perspective view of the exemplary cutting element illustrated in FIG. 12A.

FIGS. 12A-12J show portions of an exemplary drill bit according to at least one embodiment. FIGS. 12A and 12B illustrate an exemplary cutting element 818. As shown in FIGS. 12A and 12B, cutting element 818 may comprise a table 829 affixed to or formed upon a substrate 827 and a cutting face 830 formed by table 829. According to some embodiments, cutting element 818 may also comprise a back surface (e.g., back surface 19 illustrated in FIG. 2) formed opposite cutting face 830. In certain embodiments, cutting element 818 may also comprise one or more cutting edges (e.g., edges 31 and/or 33 illustrated in FIG. 2) and/or chamfers (e.g., chamfer 32 illustrated in FIG. 2) formed between at least a portion of cutting face 830 and at least a peripheral portion of cutting element 818.

According to some embodiments, cutting element 818 may comprise at least one peripheral face 888. For example, cutting element 818 may comprise a plurality of peripheral faces 888. Peripheral faces 888 may be formed to any suitable size and/or shape, without limitation. In some embodiments, peripheral faces 888 may comprise generally planar side portions of cutting element 818. In at least one embodiment, peripheral faces 888 may each be formed to substantially the same shape and/or size. In additional embodiments, peripheral faces 888 may comprise a plurality of different shapes and sizes. Cutting element 818 may comprise any suitable number of peripheral faces 888, without limitation. For example, as shown in FIGS. 12A and 12B, cutting element 818 may comprise eight peripheral faces. In some embodiments, cutting element 818 may be formed such that cutting face 830 comprises a substantially symmetrical shape. For example, as illustrated in FIGS. 12A and 12B, cutting face 830 comprises a substantially symmetrical octagonal shape bordered by peripheral faces 888.

Figure 12C:
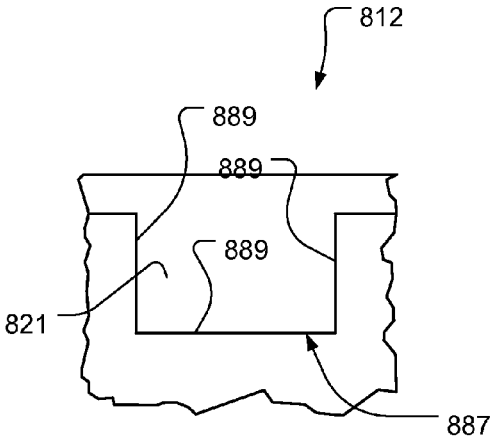
FIG. 12C is a side view of a portion of an exemplary bit body according to at least one embodiment.
Figure 12D:
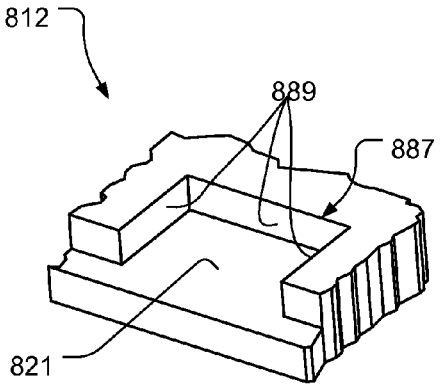
FIG. 12D is a perspective view of the portion of the exemplary bit body illustrated in FIG. 12C.

FIGS. 12C and 12D illustrate a portion of an exemplary bit body 812 defining a coupling pocket 887. According to at least one embodiment, coupling pocket 887 may be defined by a mounting surface 821 and at least one engagement surface, such as pocket engagement surfaces 889. For example, as illustrated in FIGS. 12C and 12D, coupling pocket 887 may be defined by a mounting surface 821 and three pocket engagement surfaces 889.

Figure 12E:
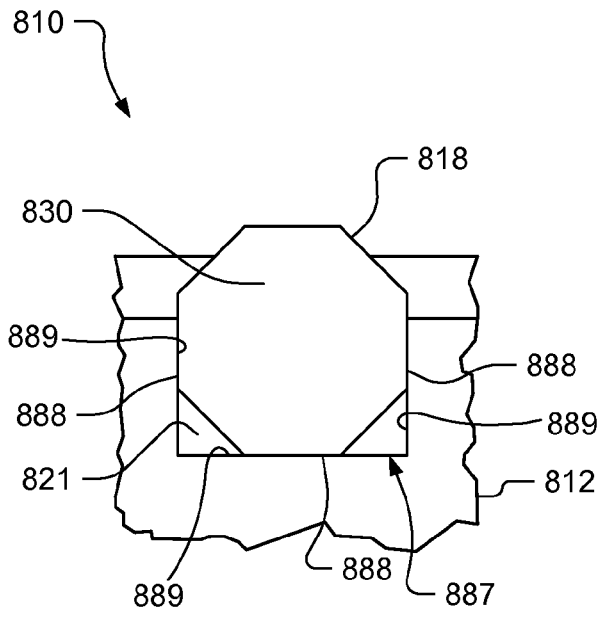
FIG. 12E is a side view of a portion of an exemplary drill bit assembly that includes the exemplary cutting element illustrated in FIGS. 12A and 12B and the portion of the exemplary bit body illustrated in FIGS. 12C and 12D.
Figure 12F:
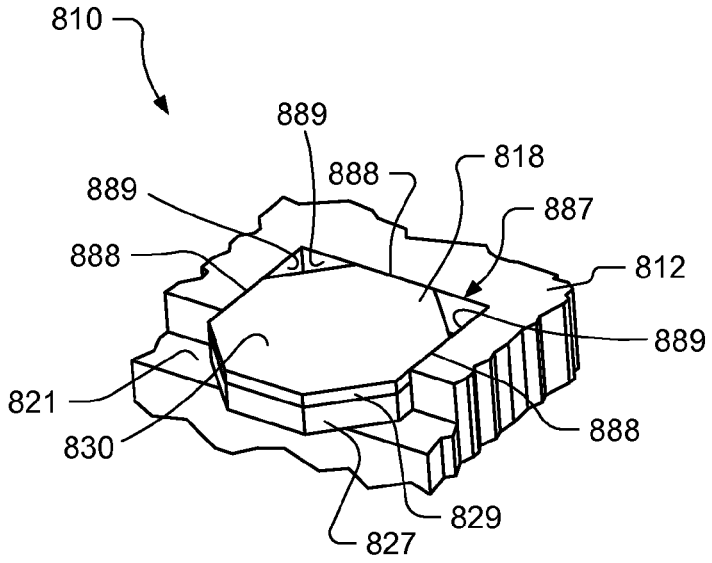
FIG. 12F is a perspective view of the portion of the exemplary drill bit assembly illustrated in FIG. 12E.

FIGS. 12E and 12F illustrate an assembly 810 of exemplary cutting element 818 illustrated in FIGS. 12A and 12B positioned within coupling pocket 887 defined by the portion of exemplary bit body 812 illustrated in FIGS. 12C and 12D. Portions of bit body 812 defining coupling pocket 887 may be configured to surround and/or abut at least a portion of cutting element 818 when cutting element 818 is mounted to bit body 812. For example, as shown in FIG. 12C, at least one of peripheral faces 888 of cutting element 818 may be positioned adjacent to and/or abutting at least one of pocket engagement surfaces 889 defining coupling pocket 887. For example, the three pocket engagement surfaces 889 shown in FIG. 12C may be positioned adjacent to and/or abutting three corresponding peripheral faces 888 of cutting element 818. Coupling pocket 887 may facilitate coupling of cutting element 818 to bit body 812. Additionally, coupling pocket 887 may restrict one or more degrees of freedom of movement of cutting element 818 relative to bit body 812 during drilling. Accordingly, cutting element 818 may be secured to bit body 812 so as to resist various forces and stresses that cutting element 818 is subjected to during drilling, preventing separation of cutting element 818 from bit body 812.

Figure 12G:
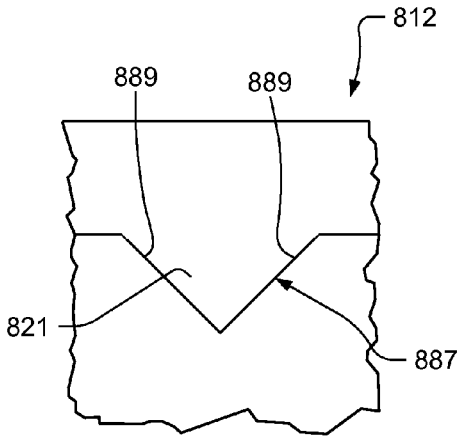
FIG. 12G is a side view of a portion of an exemplary bit body according to at least one embodiment.
Figure 12H:
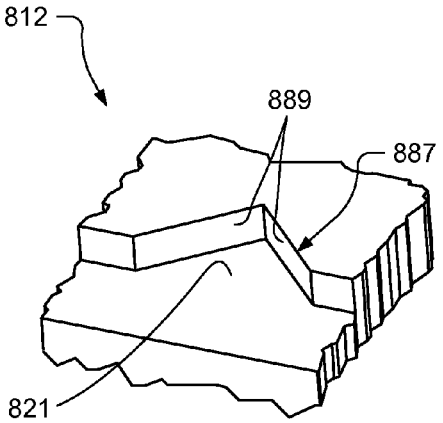
FIG. 12H is a perspective view of the portion of the exemplary bit body illustrated in FIG. 12G.

FIGS. 12G and 12H illustrate a portion of an exemplary bit body 812 defining a coupling pocket 887. According to at least one embodiment, coupling pocket 887 may be defined by a mounting surface 821 and at least one engagement surface, such as pocket engagement surfaces 889. For example, as illustrated in FIGS. 12G and 12H, coupling pocket 887 may be defined by a mounting surface 821 and two pocket engagement surfaces 889.

Figure 12I:
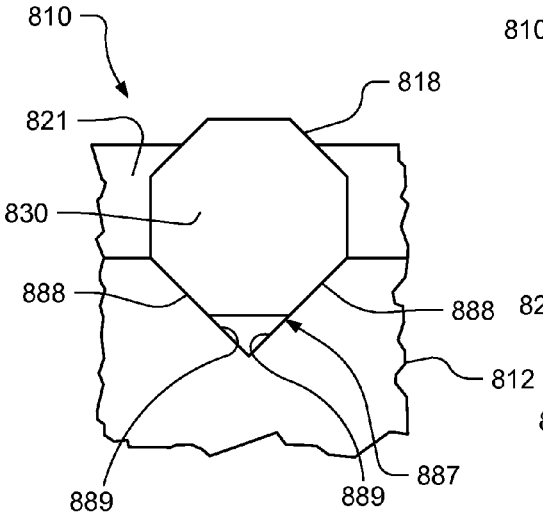
FIG. 12I is a side view of a portion of an exemplary drill bit assembly that includes the exemplary cutting element illustrated in FIGS. 12A and 12B and the portion of the exemplary bit body illustrated in FIGS. 12G and 12H.
Figure 12J:
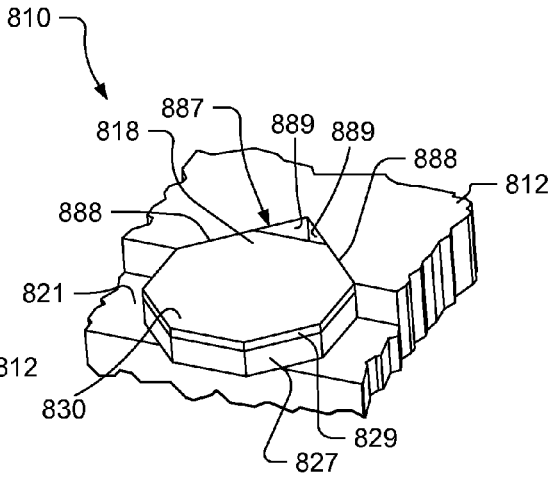
FIG. 12J is a perspective view of the portion of the exemplary drill bit assembly illustrated in FIG. 12I.

FIGS. 12I and 12J illustrate an assembly 810 of exemplary cutting element 818 illustrated in FIGS. 12A and 12B positioned within exemplary coupling pocket 887 defined by the portion of exemplary bit body 812 illustrated in FIGS. 12G and 12H. As shown in FIGS. 12I and 12J, bit body 812 may define two pocket engagement surfaces 889 that are positioned adjacent to and/or abutting two corresponding peripheral faces 888 of cutting element 818.

According to at least one embodiment, when a portion of cutting element 818 becomes worn and/or damaged during drilling, cutting element 818 may be removed from coupling pocket 887 and then repositioned within coupling pocket 887 such that a portion of cutting element 818 that is not worn or damaged is exposed to a formation being drilled. For example, prior to repositioning of cutting element 818 within coupling pocket 887, a first peripheral face 888 that is exposed to a formation during drilling may face away from coupling pocket 887. When the first peripheral face 888 becomes worn, cutting element 818 may be removed and then repositioned on bit body 812 so that the first peripheral face 888 faces toward coupling pocket 887 and so that a second peripheral face 888 faces away from coupling pocket 887. The second peripheral face 880 may then be exposed to a formation during subsequent drilling. Accordingly, cutting element 818 may continue to be used in drilling operations even after a portion of cutting element 818 becomes worn and/or damaged.

Figure 13A:
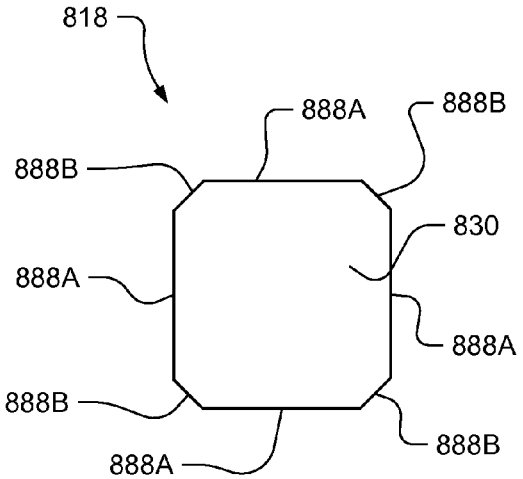
FIG. 13A is a top view of an exemplary cutting element according to at least one embodiment.
Figure 13B:
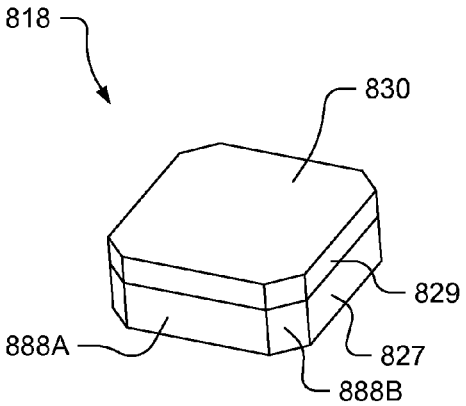
FIG. 13B is a perspective view of the exemplary cutting element illustrated in FIG. 13A.

FIGS. 13A-14B illustrate exemplary cutting elements 818 according to various embodiments. According to at least one embodiment, as illustrated in FIGS. 13A and 13B, cutting element 818 may comprise a plurality of peripheral faces 888A and 888B having different sizes and/or shapes. As shown in FIGS. 13A and 13B, four of peripheral faces 888A may comprise a first size and/or shape and four of peripheral faces 888B may comprise a second size and/or shape. For example, peripheral faces 888A may comprise a larger surface area then peripheral faces 888B. As shown in FIGS. 13A and 13B, cutting element 818 may be formed such that cutting face 830 comprises a substantially symmetrical shape that is bordered by peripheral faces 888A and 888B. Peripheral faces 888A and/or 888B may be configured to be positioned adjacent to and/or abutting at least a portion of bit body 812, such as pocket engagement surfaces 889 illustrated in FIGS. 12D and 12H, when cutting element 818 is mounted to bit body 812.

Figure 14A:
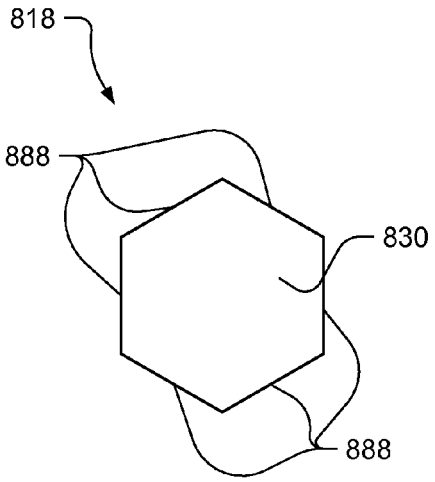
FIG. 14A is a top view of an exemplary cutting element according to at least one embodiment.
Figure 14B:
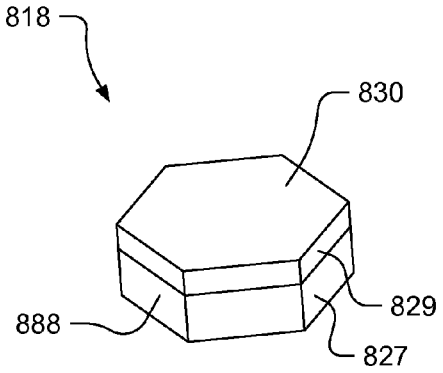
FIG. 14B is a perspective view of the exemplary cutting element illustrated in FIG. 14A.

According to certain embodiments, as illustrated in FIGS. 14A and 14B, cutting element 818 may comprise a plurality of peripheral faces 888. FIGS. 14A and 14B illustrate, for example, an exemplary cutting element 818 having six peripheral faces 888. As illustrated in FIGS. 14A and 14B, peripheral faces 888 may each comprise substantially the same shape and/or size. In additional embodiments, peripheral faces 888 may comprise a plurality of shapes and/or sizes.

Figure 15A:
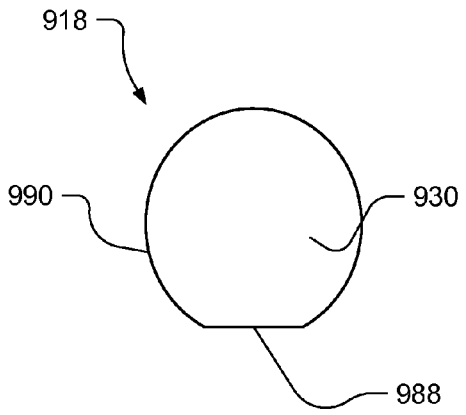
FIG. 15A is a top view of an exemplary cutting element according to at least one embodiment.
Figure 15B:
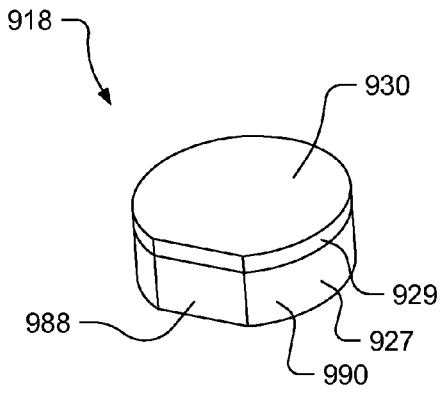
FIG. 15B is a perspective view of the exemplary cutting element illustrated in FIG. 15A.
Figure 16A:
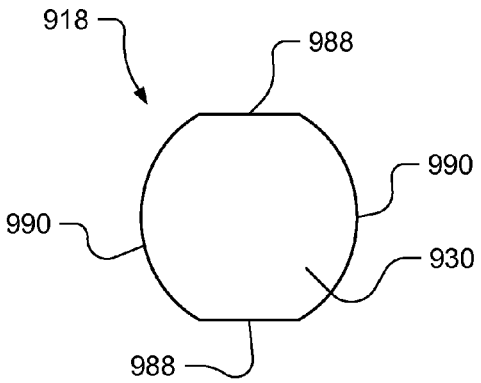
FIG. 16A is a top view of an exemplary cutting element according to at least one embodiment.
Figure 16B:
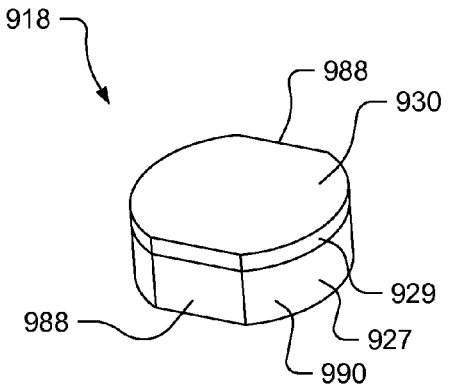
FIG. 16B is a perspective view of the exemplary cutting element illustrated in FIG. 16A.

FIGS. 15A-16B illustrate exemplary cutting elements 918 according to various embodiments. As illustrated in FIGS. 15A-16B, cutting elements 918 may comprise a table 929 affixed to or formed upon a substrate 927, a cutting face 930 formed by table 929, at least one peripheral face 988, and at least one arcuate surface portion 990 according to various embodiments. The at least one peripheral face 988 and the at least one arcuate surface portion 990 of cutting element 918 may define an outer periphery of cutting face 930. FIGS. 15A and 15B illustrate a cutting element 918 comprising one peripheral face 988 and one arcuate surface portion 990. FIGS. 16A and 16B illustrate a cutting element 918 comprising two peripheral faces 988 and two arcuate surface portions 990.

The at least one peripheral face 988 and the at least one arcuate surface portion 990 of cutting element 918 may be formed to any suitable size and/or shape, without limitation. In some embodiments, the at least one peripheral face 988 may comprise a generally planar surface portion of cutting element 918. In various embodiments, the at least one arcuate surface portion 990 of cutting element 918 may comprise a generally arcuate surface, such as a semi-circular surface, formed around a portion of cutting element 918. Arcuate surface portion 990 may also comprise any other suitable shape, without limitation. Cutting element 918 may be configured to fit within a coupling pocket formed in a portion of a bit body (e.g., coupling pocket 887 formed in bit body 812 illustrated in FIGS. 12B-12D). For example, a coupling pocket configured to surround at least a portion of cutting element 918 may be defined by at least one engagement surface, such as generally planar and/or arcuate surface corresponding to the at least one peripheral face 988 and/or the at least one arcuate surface portion 990 of cutting element 918.

Figure 17A:
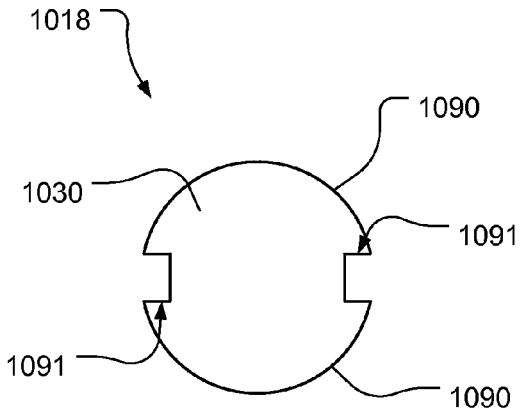
FIG. 17A is a top view of an exemplary cutting element according to at least one embodiment.
Figure 17B:
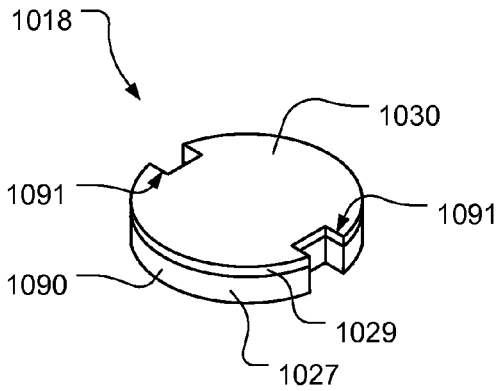
FIG. 17B is a perspective view of the exemplary cutting element illustrated in FIG. 17A.

FIGS. 17A-17F show portions of an exemplary drill bit comprising a cutting element 1018 and a coupling pocket 1087 according to at least one embodiment. FIGS. 17A and 17B illustrate an exemplary cutting element 1018 comprising a table 1029 affixed to or formed upon a substrate 1027 and a cutting face 1030 formed by table 1029. Cutting element 1018 may also comprise a back surface (e.g., back surface 19 illustrated in FIG. 2) formed opposite cutting face 1030. As shown in FIGS. 17A and 17B, cutting element 1018 may be formed such that cutting face 1030 comprises a substantially symmetrical shape.

According to at least one embodiment, cutting element 1018 may also comprise at least one arcuate surface portion 1090. The at least one arcuate surface portion 1090 of cutting element 1018 may define an outer periphery of cutting face 1030. Additionally, at least one coupling recess 1091 may be defined in at least a portion of cutting element 1018. The at least one coupling recess 1091 may comprise a recess extending generally inward relative to the at least one arcuate surface portion 1090 and/or any other peripheral surface portion of cutting element 1018. Coupling recess 1091 may comprise any suitable shape and/or size, without limitation. For example, as shown in FIGS. 17A and 17B, coupling recess 1091 may be defined by three surface portions of cutting element 1018. Cutting element 1018 may comprise any suitable number of arcuate surface portions 1090 and/or coupling recesses 1091, without limitation. FIGS. 17A and 17B illustrate, for example, a cutting element 1018 having two arcuate surface portions 1090 and two coupling recesses 1091.

Figure 17C:
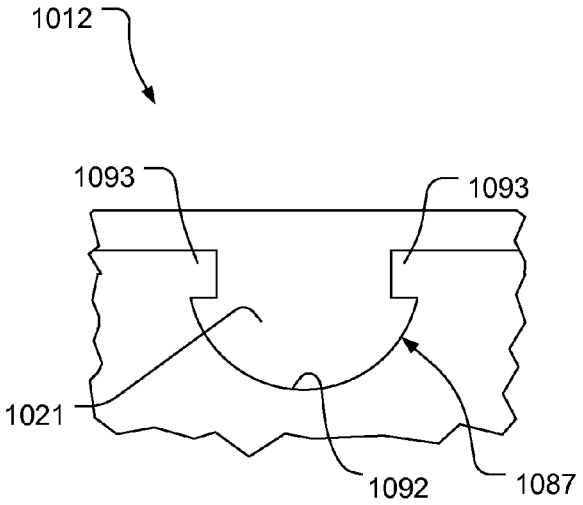
FIG. 17C is a side view of a portion of an exemplary bit body according to at least one embodiment.
Figure 17D:
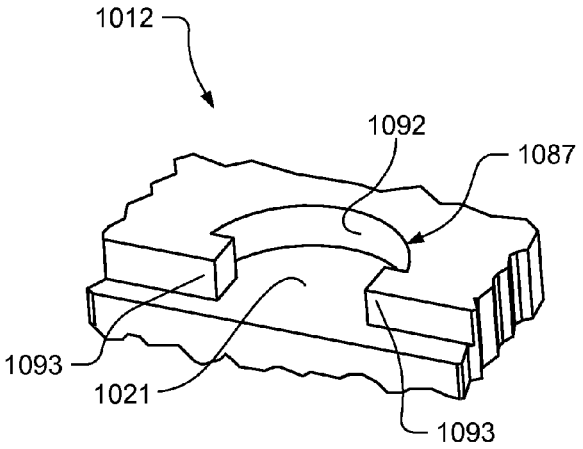
FIG. 17D is a perspective view of the portion of the exemplary bit body illustrated in FIG. 17C.

FIGS. 17C and 17D illustrate a portion of an exemplary bit body 1012 defining a coupling pocket 1087. According to at least one embodiment, coupling pocket 1087 may be defined by a mounting surface 1021 and at least one arcuate pocket surface 1092. For example, as illustrated in FIGS. 17C and 17D, coupling pocket 1087 may be defined by a mounting surface 1021 and one arcuate pocket surface 1092 having a generally arcuate shape. Additionally, at least one coupling projection 1093 may define at least a portion of coupling pocket 1087. For example, as illustrated in FIGS. 17C and 17D, bit body 1012 may include two coupling projections 1093 extending generally away from arcuate pocket surface 1092.

Portions of bit body 1012 defining coupling pocket 1087 may be configured to surround, abut, and/or fit within at least a portion of cutting element 1030 when cutting element 1030 is mounted to bit body 1012. For example, a back surface (e.g., back surface 19 illustrated in FIG. 2) of cutting element 1018 may be positioned adjacent to and/or abutting mounting surface 1021 when cutting element 1018 is mounted to bit body 1012. Additionally, at least one of arcuate pocket surface 1092 and/or coupling projections 1093 may be positioned adjacent to and/or abutting cutting element 1018.

Figure 17E:
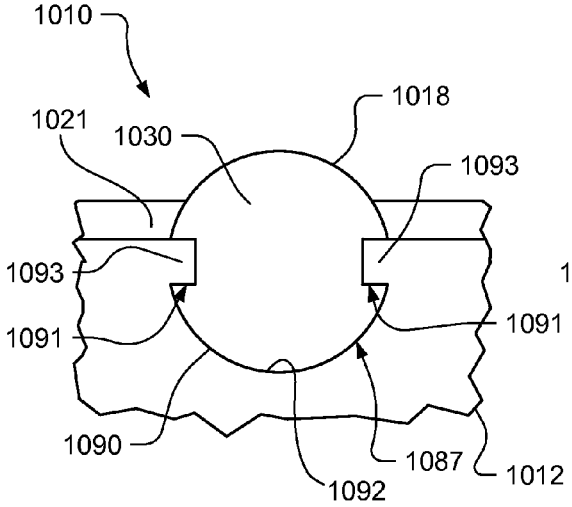
FIG. 17E is a side view of a portion of an exemplary drill bit assembly that includes the exemplary cutting element illustrated in FIGS. 17A and 17B and the portion of the exemplary bit body illustrated in FIGS. 17C and 17D.
Figure 17F:
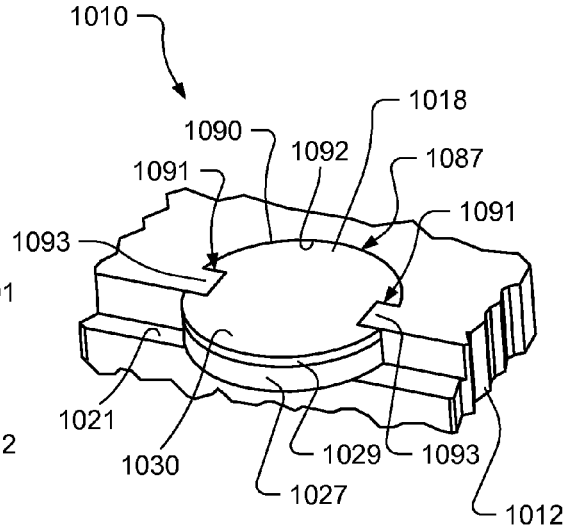
FIG. 17F is a perspective view of the portion of the exemplary drill assembly bit illustrated in FIG. 17E.

FIGS. 17E and 17F show an assembly 1010 of exemplary cutting element 1018 illustrated in FIGS. 17A and 17B positioned within coupling pocket 1087 defined by the portion of exemplary bit body 1012 illustrated in FIGS. 17C and 17D. As shown in FIGS. 17E and 17F, at least one arcuate surface portion 1090 of cutting element 1018 may be positioned adjacent to and/or abutting arcuate pocket surface 1092 defining a portion of coupling pocket 1087. For example, as shown in FIGS. 17E and 17F, arcuate pocket surface 1092 may be positioned adjacent to and/or abutting a corresponding arcuate surface portion 1090 of cutting element 1018. Additionally, at least one coupling recess 1091 of cutting element 1018 may be positioned around and/or abutting at least a portion of a coupling projection 1093 defining a portion of coupling pocket 1087. For example, as shown in FIGS. 17E and 17F, coupling recesses 1091 of cutting element 1018 may surround and/or abut corresponding coupling projections 1093 of bit body 1012 when cutting element 1018 is mounted to bit body 1012.

Coupling pocket 1087 may facilitate coupling of cutting element 1018 to bit body 1012. Additionally, coupling pocket 1087 may restrict one or more degrees of freedom of movement of cutting element 1018 relative to bit body 1012 during drilling. For example, coupling pocket 1087 may counteract forces applied to cutting element 1018 during drilling. In at least one embodiment, coupling projections 1093 of bit body 1012 may prevent cutting element 1018 from rotating and/or otherwise moving relative to coupling pocket 1087. Accordingly, cutting element 1018 may be secured to bit body 1012 so as to resist various forces and stresses that cutting element 1018 is subjected to during drilling, preventing separation of cutting element 1018 from bit body 1012.

According to at least one embodiment, when a portion of cutting element 1018 becomes worn and/or damaged during drilling, cutting element 1018 may be removed from coupling pocket 1087 and then repositioned within coupling pocket 1087 such that a portion of cutting element 1018 that is not worn or damaged is exposed to a formation being drilled. For example, cutting element 1018 may be repositioned within coupling pocket 1087 such that a first arcuate surface portion 1090 of cutting element 1018 is located adjacent arcuate pocket surface 1092 prior to repositioning. Following repositioning of cutting element 1018, a second arcuate surface portion 1090 of cutting element 1018 may be located adjacent arcuate pocket surface 1092 of coupling pocket 1087. Accordingly, cutting element 1018 may continue to be used in drilling operations even after a portion of cutting element 1018 becomes worn and/or damaged.

Figure 18A:
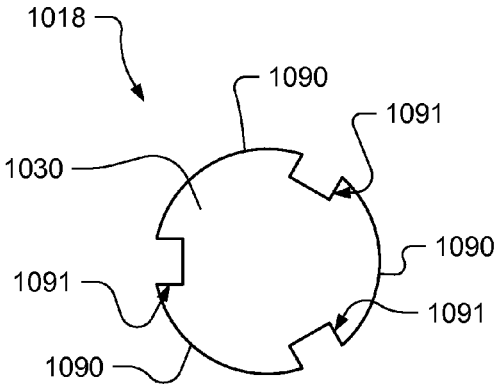
FIG. 18A is a top view of an exemplary cutting element according to at least one embodiment.
Figure 18B:
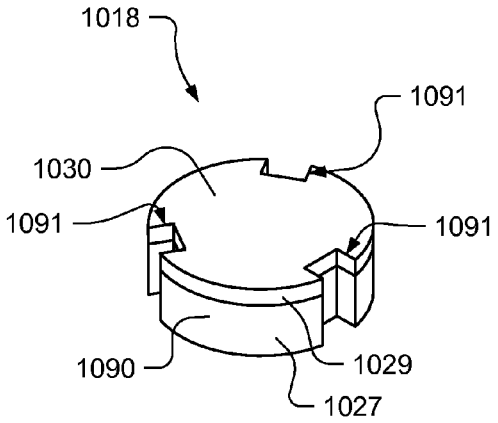
FIG. 18B is a perspective view of the exemplary cutting element illustrated in FIG. 18A.

FIGS. 18A-21B illustrate exemplary cutting elements according to various embodiments. FIGS. 18A and B illustrate a cutting element 1018 comprising three arcuate surface portions 1090 and three coupling recesses 1091. Arcuate surface portions 1090 and coupling recesses 1091 may comprise any suitable shape and/or size, without limitation. In some embodiments, arcuate surface portions 1090 and/or coupling recesses 1091 may be spaced at substantially equal intervals around a periphery of cutting element 1018. Arcuate surface portions 1090 and coupling recesses 1091 may correspond to portions of a bit body defining a coupling pocket, such as arcuate pocket surface 1092 and/or coupling projections 1093 defining coupling pocket 1087 illustrated in FIGS. 17C and 17D.

Figure 19A:
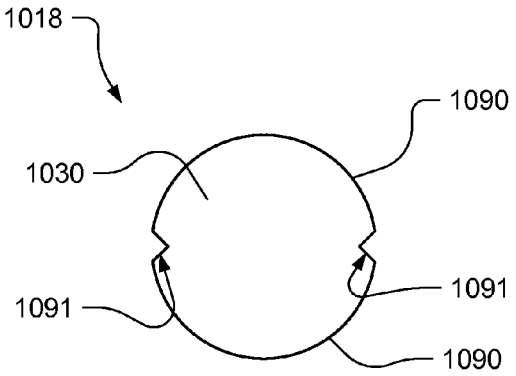
FIG. 19A is a top view of an exemplary cutting element according to at least one embodiment.
Figure 19B:
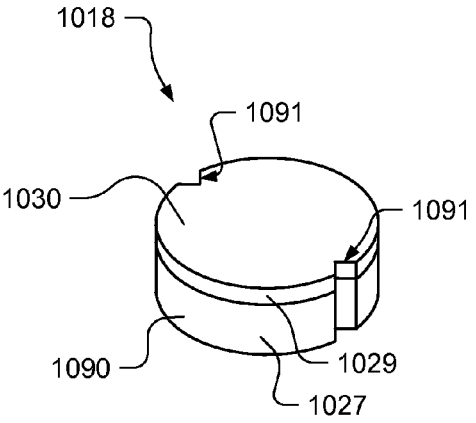
FIG. 19B is a perspective view of the exemplary cutting element illustrated in FIG. 19A.

FIGS. 19A-20B show cutting elements 1018 comprising two arcuate surface portions 1090 and two coupling recesses 1091. Arcuate surface portions 1090 and coupling recesses 1091 may comprise any suitable shape and/or size, without limitation. In at least one embodiment, as illustrated in FIGS. 19A and 19B, coupling recesses 1091 may each be defined by two generally planer surface portions. Coupling recesses 1091 illustrated in FIGS. 19A and 19B may each be configured to at least partially surround and/or abut at least a portion of a coupling projection (e.g., coupling projections 1093 of bit body 1012 illustrated in FIGS. 17C and 17D) comprising at least one generally planar surface portion corresponding to the generally planar surface portions defining coupling recesses 1091.

Figure 20A:
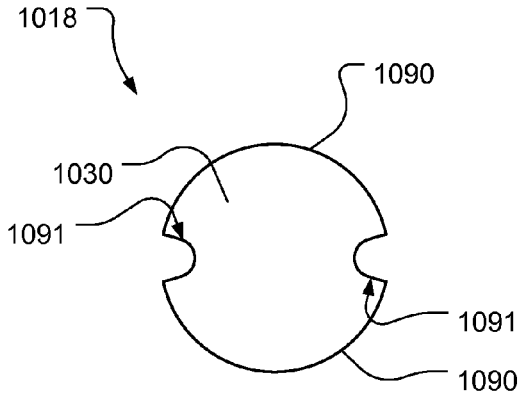
FIG. 20A is a top view of an exemplary cutting element according to at least one embodiment.
Figure 20B:
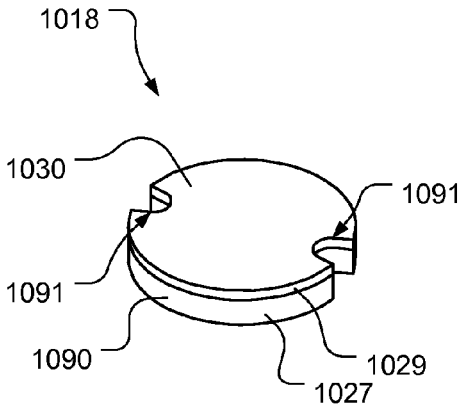
FIG. 20B is a perspective view of the exemplary cutting element illustrated in FIG. 20A.

In some embodiments, as illustrated in FIGS. 20A and 20B, coupling recesses 1091 may be defined by two generally arcuate surface portions. Coupling recesses 1091 illustrated in FIGS. 20A and 20B may each be configured to at least partially surround and/or abut at least a portion of a coupling projection (e.g., coupling projection 1093 of bit body 1012 illustrated in FIGS. 17C and 17D) comprising a generally arcuate surface shape corresponding to the generally arcuate surface portions defining coupling recess 1091.

Figure 21A:
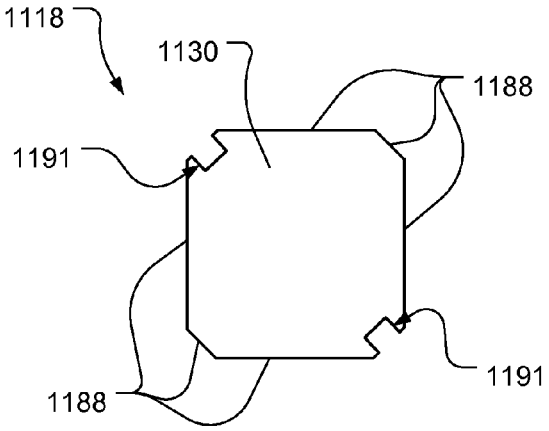
FIG. 21A is a top view of an exemplary cutting element according to at least one embodiment.
Figure 21B:
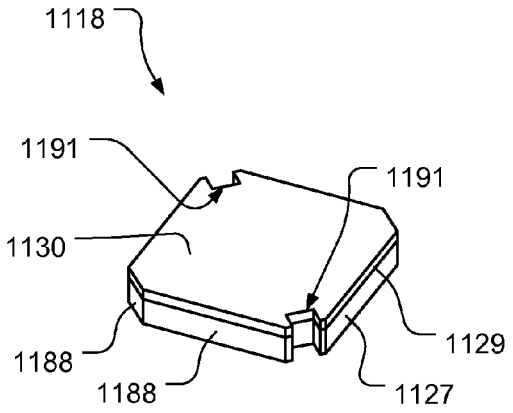
FIG. 21B is a perspective view of the exemplary cutting element illustrated in FIG. 21A.

According to various embodiments, cutting elements may comprise at least one generally planar peripheral surface (e.g., peripheral faces 888 illustrated in FIGS. 12A and 12B) in combination with at least one coupling recess (e.g., coupling recesses 1091 illustrated in FIGS. 17A-20B). For example, FIG. 21 shows a cutting element 1118 comprising a table 1129 affixed to or formed upon a substrate 1127, a cutting face 1130 formed by table 1129, peripheral faces 1188, and coupling recesses 1191. Peripheral faces 1188 and coupling recesses 1191 may correspond to portions of a bit body defining a coupling pocket, such as at least one engagement surface (e.g., pocket engagement surfaces 889 defining coupling pocket 887 illustrated in FIGS. 12C and 12D) and/or at least one coupling projection (e.g., coupling projection 1093 illustrated in FIGS. 17C and 17D).

Figure 22A:
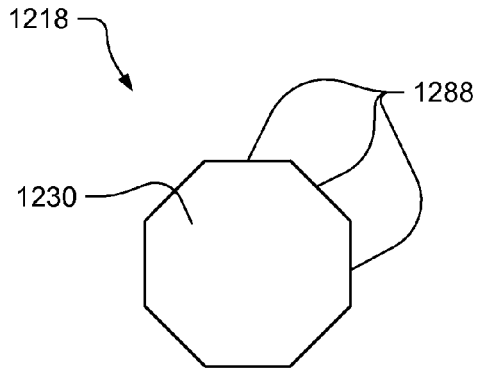
FIG. 22A is a top view of an exemplary cutting element according to at least one embodiment.

FIGS. 22A-22E show portions of an exemplary drill bit comprising a cutting element 1218 and a coupling attachment 1294 according to at least one embodiment. According some embodiments, coupling attachment 1294 may be configured to overlap at least a portion of cutting element 1218 when cutting element 1218 is mounted to a bit body 1212. As illustrated in FIG. 22A, cutting element 1218 may comprise at least one peripheral face 1288. For example, cutting element 1218 may comprise a plurality of peripheral faces 1288 defining an outer periphery of cutting face 1230. FIG. 22A shows, for example, a cutting element 1218 comprising eight peripheral faces 1288. Peripheral faces 1288 may be formed to any suitable size and/or shape, without limitation. For example, peripheral faces 1288 may comprise generally planar portions of cutting element 1218.

Figure 22B:
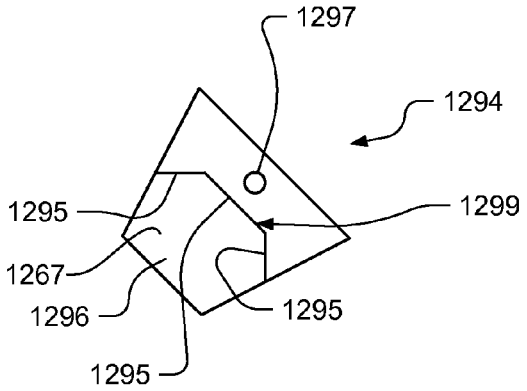
FIG. 22B is a bottom view of an exemplary coupling attachment for securing the exemplary cutting element illustrated in FIG. 22A to a drill bit according to at least one embodiment.
Figure 22C:
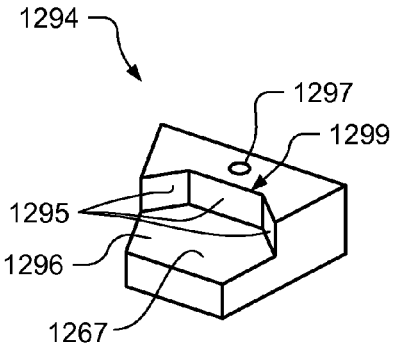
FIG. 22C is a perspective view of the exemplary coupling attachment illustrated in FIG. 22B.

FIGS. 22B and 22C show an exemplary coupling attachment 1294 according to at least one embodiment. As illustrated in FIGS. 22B and 22C, a coupling pocket 1299 may be defined within a portion of coupling attachment 1294. In at least one embodiment, coupling pocket 1299 may be defined by an overlap portion 1296 and at least one engagement surface, such as pocket engagement surfaces 1295. For example, as illustrated in FIGS. 22A and 22B, coupling pocket 1299 may be defined by an overlap portion 1296 and three pocket engagement surfaces 1295. In some embodiments, coupling attachment 1294 may not include any engagement surfaces defining coupling pocket 1299. Overlap region 1296 may include a cutting face contact surface 1267 that is configured to abut a portion of cutting face 1230 of cutting element 1218. Additionally, an opening 1297 may be defined in a portion of coupling attachment 1294.

FIG. 22D shows exemplary coupling attachment 1294 illustrated in FIGS. 22B and 22C overlapping exemplary cutting element 1218 illustrated in FIG. 22A. FIG. 22E shows coupling attachment 1294 overlapping and securing cutting element 1218 to a portion of an exemplary bit body 1212. As illustrated in FIG. 22E, a fastener 1298 may secure coupling attachment 1294 to bit body 1212 so that coupling attachment 1294 overlaps at least a portion of cutting element 1218, such as a portion of cutting face 1230. For example, fastener 1298 may extend through a portion of coupling attachment 1294, such as opening 1297, and into a portion of bit body 1212. Fastener 1298 may secure coupling attachment 1294 to cutting element 1218 and/or bit body 1212 using any suitable coupling technique, without limitation. For example, fastener 1298 may comprise a threaded projection corresponding to a threaded recess portion of bit body 1212. In some embodiments, fastener 1298 may be secured to bit body 1212 by an interference fit.

Portions of coupling attachment 1294 defining coupling pocket 1299 may be configured to surround and/or abut at least a portion of cutting element 1218 when coupling attachment 1294 is positioned over at least a portion of cutting element 1218. For example, overlap region 1296 of coupling attachment 1294 may be positioned adjacent to and/or abutting at least a portion of cutting face 1230 of cutting element 1218, as illustrated in FIGS. 22D and 22E. In some embodiments, a cutting face contact surface of coupling attachment 1294 (e.g., cutting face contact surface 1267 illustrated in FIGS. 22B and 22C) may abut at least a portion of cutting face 1230 of cutting element 1218. Additionally, at least one of pocket engagement surfaces 1295 may be positioned adjacent to and/or abutting cutting element 1218.

Accordingly, coupling attachment 1294 may facilitate coupling of cutting element 1218 to bit body 1212. Additionally, coupling attachment 1294 may restrict one or more degrees of freedom of movement of cutting element 1218 relative to coupling attachment 1294 and/or bit body 1212 during drilling. Cutting element 1218 may therefore be secured to bit body 1212 so as to resist various forces and stresses that cutting element 1218 is subjected to during drilling, preventing separation of cutting element 1218 from bit body 1212. According to certain embodiments, when a portion of cutting element 1218 becomes worn and/or damaged during drilling, coupling attachment 1294 and/or cutting element 1218 may be removed from bit body 1212 and cutting element 1218 may be repositioned with respect to bit body 1212 and coupling pocket 1299 of coupling attachment 1294. For example, cutting element 1218 may be repositioned such that a portion of cutting element 1218 that is not worn or damaged is exposed to a formation during drilling.

Figure 23:
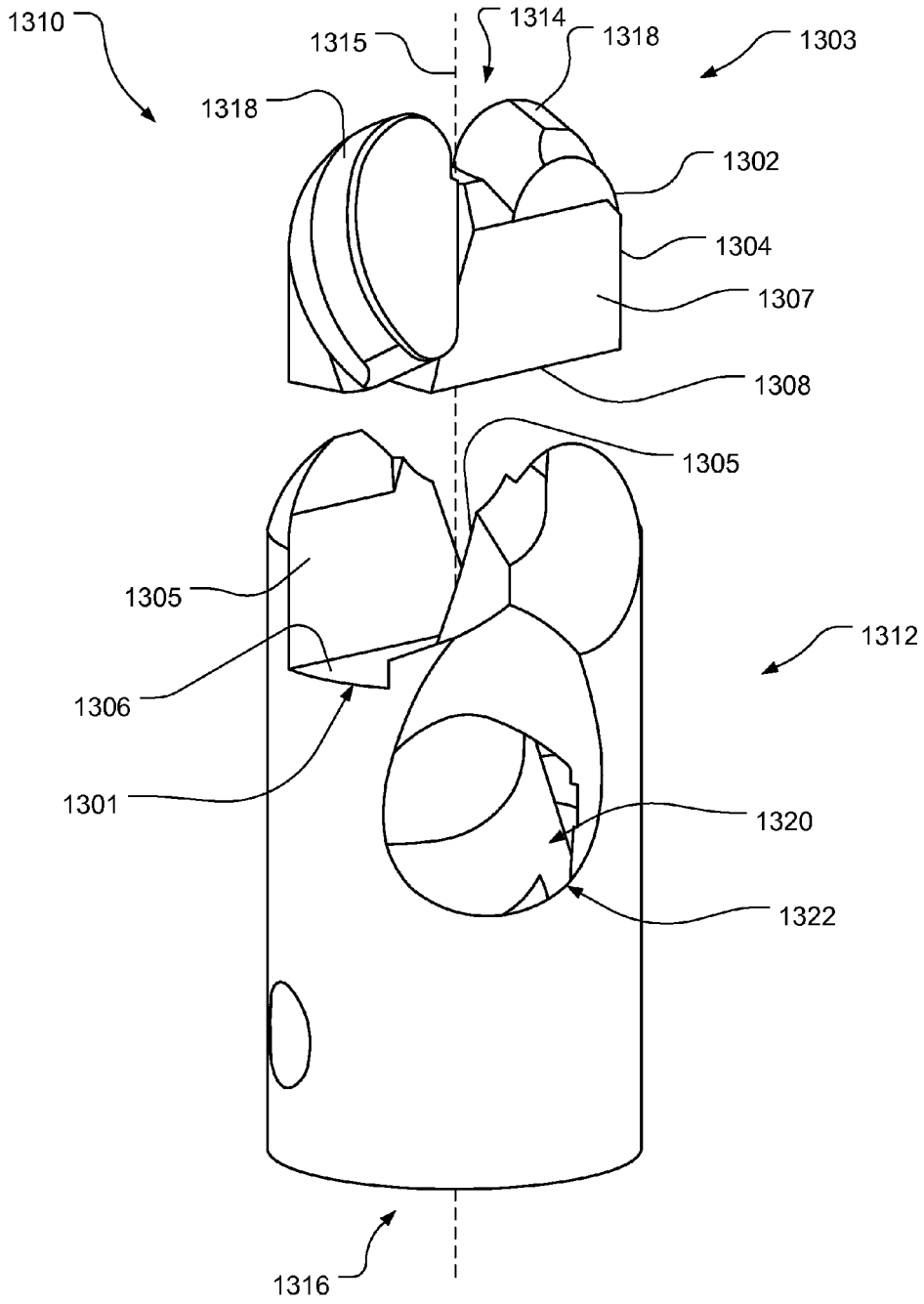
FIG. 23 is an exploded view of an exemplary drill bit according to at least one embodiment.

FIG. 23 is an exploded view of an exemplary drill bit 1310 according to at least one embodiment. Drill bit 1310 may represent any type or form of earth-boring or drilling tool, including, for example, a rotary borehole drill bit. Drill bit 1310 may be formed of any material or combination of materials, such as steel and/or molded tungsten carbide, without limitation. As illustrated in FIG. 23, drill bit 1310 may comprise a forward end 1314 and a rearward end 1316 and may be rotatable about a central axis 1315. Drill bit 1310 may also comprise a bit body 1312 and a cutting element assembly 1303 coupled to bit body 1312. Cutting element assembly 1303 may comprise an assembly body 1302 and a cutting portion that includes at least one cutting element 1318 coupled to assembly body 1302. For example, as shown in FIG. 23, a plurality of cutting elements 1318 may be coupled to assembly body 1302.

In at least one embodiment, an internal passage 1320 may be defined within bit body 1312. As illustrated in FIG. 23, internal passage 1320 may extend from a rearward opening (e.g., rearward opening 11 illustrated in FIG. 1) defined in rearward end 1316 of bit body 1312 to at least one side opening 1322 defined in a side portion of bit body 1312. In one embodiment, internal passage 1320 may be configured to draw debris, such as rock cuttings, away from cutting elements 1318 during drilling.

According to various embodiments, cutting element assembly 1303 may be configured to be coupled to bit body 1312. For example, as illustrated in FIG. 23, cutting element assembly 1303 may comprise a coupling portion 1304 shaped and configured to fit within a coupling recess 1301 defined within a portion of bit body 1312. In at least one embodiment, coupling recess 1301 may be defined within a forward portion of bit body 1312. Coupling recess 1301 may be defined by at least one surface portion of bit body 1312. For example, as shown in FIG. 23, coupling recess 1301 may be defined by a rearward coupling surface 1306 and two side coupling surfaces 1305 of bit body 1312. Rearward coupling surface 1306 may define a rearward portion of coupling recess 1301, and side coupling surfaces 1305 may define side portions of coupling recess 1301. In some embodiments, side coupling surfaces 1305 may extend away from rearward coupling surface 1306 in a generally forward direction.

Coupling portion 1304 of cutting element assembly 1303 may comprise one or more surfaces corresponding to rearward coupling surface 1306 and/or side coupling surfaces 1305 of bit body 1312. For example, coupling portion 1304 may comprise a rearward assembly surface 1308 corresponding to rearward coupling surface 1306 of bit body 1312 and at least one side assembly surface 1307 corresponding to at least one of side coupling surfaces 1305 of bit body 1312. According to at least one embodiment, coupling portion 1304 of assembly body 1302 may be positioned within coupling recess 1301 such that rearward assembly surface 1308 of coupling portion 1304 is adjacent to and/or abutting rearward coupling surface 1306 of bit body 1312. Additionally, one or more of side assembly surfaces 1308 of coupling portion 1304 may be disposed adjacent to and/or abutting side coupling surfaces 1305 of bit body 1312 when coupling portion 1304 of assembly body 1302 is positioned within coupling recess 1301.

Assembly body 1302 of cutting element assembly 1303 may be coupled to bit body 1312 using any suitable technique. For example, assembly body 1302 may be brazed, welded, soldered, and/or otherwise adhered and/or fastened to bit body 1312. In at least one embodiment, rearward assembly surface 1308 and/or side assembly surface 1307 of coupling portion 1304 may be brazed to rearward coupling surface 1306 and/or at least one of side coupling surfaces 1305 defining coupling recess 1301 in bit body 1312.

When assembly body 1302 of cutting element assembly 1303 is coupled to bit body 1312, coupling recess 1301 may prevent separation of assembly body 1302 from bit body 1312. For example, when drill bit 1310 is rotated relative to a rock formation during drilling, coupling portion 1304 of assembly body 1302 may be secured within coupling recess 1301 defined in bit body 1312, thereby restricting one or more degrees of freedom of movement of assembly body 1302 relative to bit body 1312. According to some embodiments, rearward assembly surface 1308 and/or side assembly surface 1307 of coupling portion 1304 may be forced against rearward coupling surface 1306 and/or at least one of side coupling surfaces 1305 during drilling. Accordingly, portions of bit body 1312 defining coupling recess 1301 may resist various forces and stresses that drill bit 1310 is subjected to during drilling, thereby preventing separation of cutting element assembly 1303 from bit body 1312.

The preceding description has been provided to enable others skilled the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A roof-bolt drill bit, comprising:

a bit body rotatable about a central axis;

a coupling pocket defined in the bit body, the coupling pocket including a back mounting surface and a side surface;

at least one cutting element mounted to the bit body, the at least one cutting element having a non-cylindrical periphery and comprising:

a cutting face;

a cutting edge adjacent the cutting face;

a back surface opposite the cutting face;

a side surface extending between the cutting edge and the back surface;

a coupling attachment coupled to the bit body, the coupling attachment abutting the cutting face of the at least one cutting element, the coupling attachment extending beyond and overlapping a portion of the side surface of the at least one cutting element;

wherein the side surface of the at least one cutting element abuts the coupling pocket.

2. The roof-bolt drill bit of claim 1, wherein the coupling attachment abuts the side surface of the at least one cutting element.

3. The roof-bolt drill bit of claim 1, wherein the coupling attachment extends from the bit body to the at least one cutting element.

4. The roof-bolt drill bit of claim 1, wherein the coupling attachment comprises an engagement feature positioned adjacent to the at least one cutting element.

5. The roof-bolt drill bit of claim 1, wherein:

the at least one cutting element defines a recess;

a portion of the coupling attachment is disposed within the recess.

6. The roof-bolt drill bit of claim 1, wherein:

the coupling attachment defines a recess;

a portion of the at least one cutting element is disposed within the recess.

7. The roof-bolt drill bit of claim 1, wherein:

the at least one cutting element defines a recess;

a portion of the bit body is disposed within the recess.

8. The roof-bolt drill bit of claim 1, wherein the coupling attachment includes a threaded portion.

9. The roof-bolt drill bit of claim 8, wherein:

the coupling attachment is rotatable between a locked position and an unlocked position;

in the locked position, the coupling attachment abuts a portion of the at least one cutting element;

in the unlocked position, the coupling attachment does not abut the at least one cutting element.

10. The roof-bolt drill bit of claim 1, wherein:

the at least one cutting element comprises a plurality of side surfaces;

the coupling attachment abuts two or more of the plurality of side surfaces of the at least one cutting element.

11. The roof-bolt drill bit of claim 10, wherein each of the plurality of side surfaces of the at least one cutting element are disposed at an angle with respect to each other.

12. The roof-bolt drill bit of claim 1, wherein the at least one cutting element comprises two cutting elements positioned circumferentially substantially 180° apart with substantially the same back rake and side rake angles.

13. The roof-bolt drill bit of claim 1, wherein the at least one cutting element further comprises a superabrasive material bonded to a substrate.

14. The roof-bolt drill bit of claim 13, wherein the superabrasive material comprises a polycrystalline diamond material.

15. A roof-bolt drill bit, comprising:

a bit body rotatable about a central axis;

a coupling pocket defined in the bit body, the coupling pocket including a back mounting surface and a side surface;

at least one cutting element mounted to the bit body, the at least one cutting element having a non-cylindrical periphery and comprising:

a cutting face;

a cutting edge adjacent the cutting face;

a back surface opposite the cutting face;

a coupling attachment extending through a portion of the bit body into a coupling recess defined in the at least one cutting element adjacent to the back surface of the at least one cutting element;

a coupling insert positioned within the at least one cutting element, the coupling insert defining the coupling recess in the at least one cutting element.

16. The roof-bolt drill bit of claim 15, wherein the coupling attachment is threadedly coupled within the coupling recess.

* * * * *